US007970602B2

(12) United States Patent
Toma et al.

(10) Patent No.: US 7,970,602 B2
(45) Date of Patent: Jun. 28, 2011

(54) DATA REPRODUCTION DEVICE

(75) Inventors: Tadamasa Toma, Osaka (JP); Yoshinori Matsui, Nara (JP); Shinya Kadono, Hyogo (JP)

(73) Assignee: Panasonic Corporation, Osaka (JP)

( * ) Notice: Subject to any disclaimer, the term of this patent is extended or adjusted under 35 U.S.C. 154(b) by 1102 days.

(21) Appl. No.: 11/578,781

(22) PCT Filed: Feb. 24, 2006

(86) PCT No.: PCT/JP2006/303473
§ 371 (c)(1),
(2), (4) Date: Oct. 18, 2006

(87) PCT Pub. No.: WO2006/090852
PCT Pub. Date: Aug. 31, 2006

(65) Prior Publication Data

US 2009/0228283 A1 Sep. 10, 2009

(30) Foreign Application Priority Data

Feb. 24, 2005 (JP) ..... 2005-049052

(51) Int. Cl.
*G10L 19/00* (2006.01)

(52) U.S. Cl. ..... 704/201; 704/200; 704/200.1; 704/500; 704/501

(58) Field of Classification Search ..... 704/200–201, 704/500, 501
See application file for complete search history.

(56) References Cited

U.S. PATENT DOCUMENTS

| | | | | |
|---|---|---|---|---|
| 6,208,957 | B1 | 3/2001 | Nomura | |
| 2004/0078205 | A1 * | 4/2004 | Liljeryd et al. | 704/503 |
| 2005/0080621 | A1 * | 4/2005 | Tsushima et al. | 704/229 |
| 2006/0036432 | A1 * | 2/2006 | Kjorling et al. | 704/206 |
| 2006/0100859 | A1 * | 5/2006 | Jelinek et al. | 704/201 |
| 2007/0112559 | A1 * | 5/2007 | Schuijers et al. | 704/203 |
| 2008/0004883 | A1 * | 1/2008 | Vilermo et al. | 704/500 |

FOREIGN PATENT DOCUMENTS

| | | |
|---|---|---|
| EP | 0 890 943 | 1/1999 |
| JP | 11-30997 | 2/1999 |
| JP | 2003-114845 | 4/2003 |
| JP | 2004-302259 | 10/2004 |

(Continued)

OTHER PUBLICATIONS

Supplementary European Search Report issued Jun. 16, 2009 in corresponding European Patent Application No. 06 71 4612.

(Continued)

*Primary Examiner* — Richemond Dorvil
*Assistant Examiner* — Douglas C Godbold
(74) *Attorney, Agent, or Firm* — Wenderoth, Lind & Ponack, L.L.P.

(57) ABSTRACT

A data reproduction device is provided for achieving seamless reproduction of a stream where a validity of a bandwidth extension function is switched in the stream. The data reproduction device includes an input frequency obtainment unit analyzing header information Hdr and obtaining an input frequency FSin, which is the frequency of basic data, an output frequency determination unit performing predetermined processing based on the input frequency FSin and determining an output frequency FSout, which is the sampling frequency of a decoded frame Fdata, and a decoding unit (2003) which, if the SBR function is valid in a frame to be decoded, decodes sample data at the input frequency FSin and extends the bandwidth of the sampling frequency up to the output frequency FSout, while if the SBR function is not valid in the frame, upsamples the decoding result obtained at the input frequency FSin to the output frequency FSout.

6 Claims, 17 Drawing Sheets

FOREIGN PATENT DOCUMENTS

JP 2005-222014 8/2005

OTHER PUBLICATIONS

Wolters, M., et al. "*A closer look into MPEG-4 High Efficiency AAC*" Preprints of papers presented at the AES Convention, vol. 115, Oct. 10, 2003, pp. 1-15, XP008063876.

"Text of ISO/IEC 14496-3:2001/FPDAM 1", Joint Video Team (JVT) of ISO/IEC MPEG & ITU-T VCEG (ISO/IEC JTC1/SC29/WG11 and ITU-T SG16 Q6), No. N5203, Nov. 1, 2002, XP 030012511.

* cited by examiner

FIG. 3B

FIG. 3A

DATA REPRODUCTION DEVICE

BACKGROUND OF THE INVENTION

1. Field of Invention

The present invention relates to a data reproduction device which demultiplexes data such as video and audio multiplexed in a bitstream, and decodes and reproduces such data.

2. Description of the Related Art

In recent years, with the increase in capacity of storage media and communication networks and the advance of data transmission technology, devices and services involving coded multimedia data, such as video and audio, have come into wide use.

For example, in the broadcasting sector, broadcasting of digitally coded media data has replaced conventional analog broadcasting. Although the current digital broadcasting is directed only to landline receivers, broadcasting for mobile devices such as cellular phones is scheduled to commence. In the communication sector, for example, video distribution services for third generation cellular phones have started, and an environment for handling multimedia data has been created not only on landline terminals but also mobile terminals. Accordingly, it is expected that multimedia will be used increasingly in various manners, in which, for example, content data received via broadcasting or the Internet is recorded in a memory card such as a secure digital (SD) card or an optical disk such as a digital versatile disk-rewritable (DVD-RAM) and shared between devices.

Here, the Advanced Audio Coding (AAC) standard developed by the Moving Picture Expert Group (MPEG) is taken as a typical example of audio data coding format, which is widely used in digital broadcasting, video distribution services for the third generation cellular phones, and the like.

Generally, in coding of audio data, the upper limit of the frequency band for reproduction is lowered as the compression ratio increases, and thus the sound quality degrades accordingly. This is because not enough bits are allocated to coding of high frequency components. So, in order to recover the missing high frequency components, a technique called Spectral Band Replication (SBR) for generating high frequency components through artificial extension of bandwidth has been developed. To be more specific, by performing bandwidth extension processing on coded data, using supplementary information stored in a stream for estimating high frequency components from low frequency components, it becomes possible to reproduce high quality sound from such coded data even if it is compressed at a higher ratio and thus at a lower bitrate. Here, assuming that AAC coded data included in data of one frame is called basic data, frame data is made up of such basic data and SBR data. With the SBR tool, double the bandwidth of the basic data can typically be reconstructed, and therefore, for example, output data of 32 kHz can be obtained from basic data of 16 kHz. Note that a coding format enhanced by adding a SBR function to the conventional AAC is called AAC-plus. Here, an AAC-plus frame, which does not include SBR data, is decoded as data in AAC format. Since AAC-plus is compatible with AAC, a decoding unit for AAC-plus can decode coded data in AAC format. A decoding unit for AAC can also decode only basic data by skipping the reading of SBR data in AAC-plus. In the following description, AAC-plus denotes a coding format including both MPEG-2 and MPEG-4 in a comprehensive manner, while MPEG-2 AAC and MPEG-4 AAC denote separate coding formats.

As described above, since AAC-plus is particularly effective at a lower bitrate, it is expected to be expanded to services for mobile devices. For example, it is to be used for third generation mobile terminals, digital terrestrial broadcasting for mobile devices, or the like. Note that MPEG-2 AAC is used in digital terrestrial broadcasting for mobile devices. FIG. 1 is a diagram showing an overview of digital terrestrial broadcasting for mobile devices. Audio data and video data multiplexed in a transport stream (TS) in MPEG-2 format are transmitted from a broadcast station. TS is a stream of fixed length packets of 188 bytes each, called TS packets, and a cellular phone, an in-vehicle terminal or the like receives these TS packets. Here, in a TS, a data unit called a section, which stores TV show information, is transmitted along with audio data and video data, while the reception side analyzes the TV show information in the section and then starts receiving the TS packets storing the audio data and video data. A section showing TV show information is called a program map table (PMT).

When carrying coded data in AAC or AAC-plus format via a TS packet, the frames of the coded data are carried after being converted to audio data transport stream (ADTS) frames in MPEG-2 format. FIG. 2 shows a data structure of an ADTS frame. The header of an ADTS frame stores information such as a sampling frequency, the number of channels, and the like of audio data stored in the payload, and the payload of the ADTS frame stores data of one frame in AAC or AAC-plus format. In the case of AAC-plus, since the sampling frequency stored in the ADTS header indicates the sampling frequency of basic data, the sampling frequency of bandwidth-extended data cannot be obtained from the ADTS header.

Next, recording of digital terrestrial broadcasts for mobile devices received on a mobile terminal is described. With the commencement of digital broadcasting for mobile terminals, broadcasts are supposed to be recorded. An MP4 file format (hereinafter referred to as MP4) is expected to be used as a multiplexing format for recording them, from a standpoint of ensuring interconnectability with the third generation mobile terminals. Here, MP4 is a file format standardized by ISO/IEC JTC1/SC29/WG 11, and is adopted in Transparent end-to-end packet switched streaming service (TS26.234) defined, as a wireless video distribution standard, by the Third Generation Partnership Project (3GPP), which is an international standardization organization aimed at standardization of a third generation mobile communications system. In the 3GPP standard, MPEG-4 AAC is used as AAC. Since MPEG-4 AAC has backward compatibility with MPEG-2 AAC, a terminal which is compliant with MPEG-4 AAC can correctly decode and reproduce MPEG-2 AAC coded data. Even a terminal which is compliant only with MPEG-2 AAC can also correctly decode and reproduce MPEG-4 AAC coded data if the data is coded without using a function specific to MPEG-4 AAC.

Description is given below regarding a method for multiplexing AU data in MP4. Here, AU is equivalent to one picture in a video sequence or one frame in an audio sequence. In MP4, media data is handled in units of samples. One sample is equivalent to one AU, and sample numbers, which are incremented one-by-one in decoding time order, are assigned to respective samples. Furthermore, header information and media data per sample is managed in units of objects called Boxes. FIG. 3A shows a structure of a Box made up of the following fields:

(1) Size: total size of a Box including a size field; (2) type: identifier of a Box and typically represented by four alphabetical letters (a field length is 4 bytes, and a Box in an MP4 file is searched while judging whether or not data of consecutive 4 bytes matches the identifier stored in the type field); (3)

version: version number of a Box; (4) flags: flag information set for each Box; and (5) data: header information and media data are stored therein.[0010] Note that since "version" and "flags" are not mandatory fields, some Boxes do not contain these fields. Identifiers of type fields are used in referring to Boxes in the following description. For example, the Box whose type is "moov" is called "moov". The Box structure in the MP4 file is shown in FIG. 3B. The MP4 file is composed of "fytp", "moov" and, "mdat" or "moof", and "fytp" is positioned at the beginning of the MP4 file. Information for identifying an MP4 file is included in "fytp", and media data is stored in "mdat". Each media data included in "mdat" is called a track, and each track is identified by a track ID. Next, header information on a sample included in each track of "mdat" is stored in "moov". In "moov", as shown as FIG. 4A, Boxes are hierarchically placed, and header information for audio media data and header information for video media data are separately stored in respective "trak" fields. In a "trak", Boxes are also hierarchically placed, and the following information is stored in each Box in "stbl": size, decoding time and display starting time of each sample; or information on each randomly-accessible sample (FIG. 4B). Such randomly-accessible samples are called Sync samples, and a list of sample numbers of the Sync samples is shown by "stss" in "stbl". The header information of all the samples in a track is stored in "moov" in the above description, but it is possible to divide this track into fragments and store the header information on a fragment-by-fragment basis. The header information on each unit obtained by dividing the track is shown in "moof". In the example of a fragmented MP4 file in FIG. 5, the header information of samples to be stored in "mdat#1" can be stored in "moof#1".

FIG. 6 is a diagram showing a structure example of a conventional MP4 file in which broadcast data is recorded. Received AAC data is recorded in a conventional MP4 file, as MPEG-2 AAC data. Therefore, identification information indicating that the audio track in the MP4 file for recording data is in MPEG-2 AAC format is stored in "moov". In addition, since AAC coded data is different from MPEG-4 AAC data, the type of the coded data stored in the MP4 file does not comply with the 3GPP standard. Furthermore, there is no identification information indicating whether the SBR function is valid or not in the header of the MP4 file storing MPEG-2 AAC data, and only the frequency of the basic data in AAC-plus format is indicated there.

In addition, since a conventional brand defined for each operational standard such as SD is used, it is not possible to judge from the brand stored in "ftyp" whether or not digital terrestrial broadcast data is recorded in the MP4 file.

FIG. 7 is a block diagram showing a configuration of a conventional data reproduction device 1000 which reproduces a conventional MP4 file. The data reproduction device 1000 includes a header separation unit 1001, an input frequency obtainment unit 1002, a decoding unit 1003 and an output unit 1004, and demultiplexes coded audio data and coded video data from an input MP4 file, decodes them, and reproduces them (see, for example, Patent Document 1). A description is given about operations for AAC reproduction, and a description about operations for video reproduction is omitted. Note that the audio coding format in the present invention is not limited to AAC or AAC-plus, and it may be AC3, MP3, or any other format having a bandwidth extension function additionally to such coding format.

The header separation unit 1001 separates the header from the MP4 file, outputs, to the input frequency obtainment unit 1002, the header information Hdr including at least information indicating an audio sampling frequency, and outputs the sample data separated from "mdat" to the decoding unit 1003. Here, in AAC-plus, the frequency of the basic data is indicated as a sampling frequency. The input frequency obtainment unit 1002 analyzes the header information Hdr, obtains the input frequency FSin that is the frequency of the basic data, and outputs it to the decoding unit 1003. The decoding unit 1003 decodes the sample data Sp1Dat based on the input frequency FSin, and outputs, to the output unit 1004, the decoded frame Fdata which is the decoding result and the output frequency FSo which is the sampling frequency of the decoded frame Fdata. The output unit 1004 outputs the decoded frame Fdata in accordance with the output frequency FSo.

Patent Document 1: Japanese Laid-Open Patent Application No. 2003-114845.

BRIEF SUMMARY OF THE INVENTION

However, in the conventional data reproduction device 1000, since the output unit 1004 obtains the output frequency FSo of the decoded frame Fdata after decoding the sample data Sp1Dat, it has the following problem.

FIG. 8 is a diagram showing the problem in reproducing an MP4 file in the conventional data reproduction device 1000. The upper half of FIG. 8 shows one example of a structure of an AAC-plus stream stored in the MP4 file. In this example, the sampling frequency of the basic data is 24 kHz, and the SBR function is valid in the intervals from 0 to 10 seconds and from 20 to 30 seconds, while the SBR function is invalid in the interval from 10 to 20 seconds. In this case, the sampling frequency of the decoded frame Fdata that is the decoding result by the decoding unit 1003 is as shown in the lower part of FIG. 8, and the frequency is upsampled to 48 kHz through bandwidth extension processing in the intervals from 0 to 10 seconds and 20 to 30 seconds, while the input frequency 24 kHz is outputted as it is in the interval from 10 to 20 seconds.

In this case, since the sampling frequency of the decoded frame Fdata is switched at the positions of reproduction time, 10 seconds and 20 seconds, the output unit 1004 needs to perform the processing for switching the output frequency FSo at those timings. It takes a certain period of time to switch the output frequency FSo, which results in a problem that reproduction is interrupted at the switching position 1100.

Therefore, the present invention has been conceived in view of the above-mentioned problem. An object of the present invention is to provide a data reproduction device that can achieve seamless reproduction of a stream at the positions in the stream at which the validity of the bandwidth extension function is switched.

In order to achieve the above object, the data reproduction device according to the present invention is a data reproduction device which reproduces a coded stream including pieces of frame data obtained by coding audio data, and bandwidth extension information used for extending a reproduction frequency band of part of the pieces of frame data, and this data reproduction device includes: an obtainment unit which obtains a basic sampling frequency of the pieces of frame data from the coded stream; a determination unit which determines, based on the basic sampling frequency, an output sampling frequency at which the pieces of frame data should be reproduced to be a sampling frequency to which the reproduction frequency band of the part of the pieces of frame data is extended using the bandwidth extension information; and a decoding unit which decodes the pieces of frame data at the basic sampling frequency, and in the case where the output sampling frequency is different from the basic sampling frequency, extends the reproduction frequency band of the part of the decoded pieces of frame data using the bandwidth extension information, and upsamples the basic sampling frequency of the other part of the decoded pieces of frame data to the output sampling frequency. With this configuration, the data reproduction device of the present invention can keep the output sampling frequency constant even if the validity of the bandwidth extension function is switched in a stream that is made up of plural pieces of frame data, and thus can realize seamless reproduction of the stream at the positions at which the validity of the bandwidth extension function is switched.

The above-mentioned determination unit may determine the output sampling frequency to be the sampling frequency to which the reproduction frequency band of the part of the decoded pieces of frame data is extended using the bandwidth extension information, in the case where the basic sampling frequency is a predetermined value or lower.

The above-mentioned determination unit may determine the output sampling frequency to be the sampling frequency to which the reproduction frequency band of the part of the decoded pieces of frame data is extended using the bandwidth extension information, only in the case where the basic sampling frequency is a specific value.

The obtainment unit may obtain, from the coded stream, identification information indicating a possibility that the coded stream includes both the frame data having the bandwidth extension information and the frame data not having the bandwidth extension information, and the determination unit may determine the output sampling frequency based on the basic sampling frequency and the identification information. Accordingly, for example, in the case where there is no possibility that the first frame data includes both the part having the corresponding second frame data and the part not having such second frame data, the output sampling frequency can easily be determined.

Note that the present invention can be implemented not only as the above-described data reproduction device, but also as a data reproduction method including, as steps, the characteristic units of such a data reproduction device, or as a program causing a computer to execute these steps. Also, such a program can be distributed via a non-transitory recording medium such as a CD-ROM, or a transmission medium such as the Internet.

The data reproduction device of the present invention can keep the output sampling frequency constant even if the validity of the bandwidth extension function is switched in a stream, and thus can realize seamless reproduction of the stream at the positions in the stream at which the validity of the bandwidth extension function is switched.

BRIEF DESCRIPTION OF DRAWINGS

FIG. 3A and FIG. 3B are diagrams showing a Box structure of an MP4 file.

DETAILED DESCRIPTION OF THE INVENTION

The embodiments of the present invention will hereinafter be described with reference to the attached drawings.

First Embodiment

Figure 9:
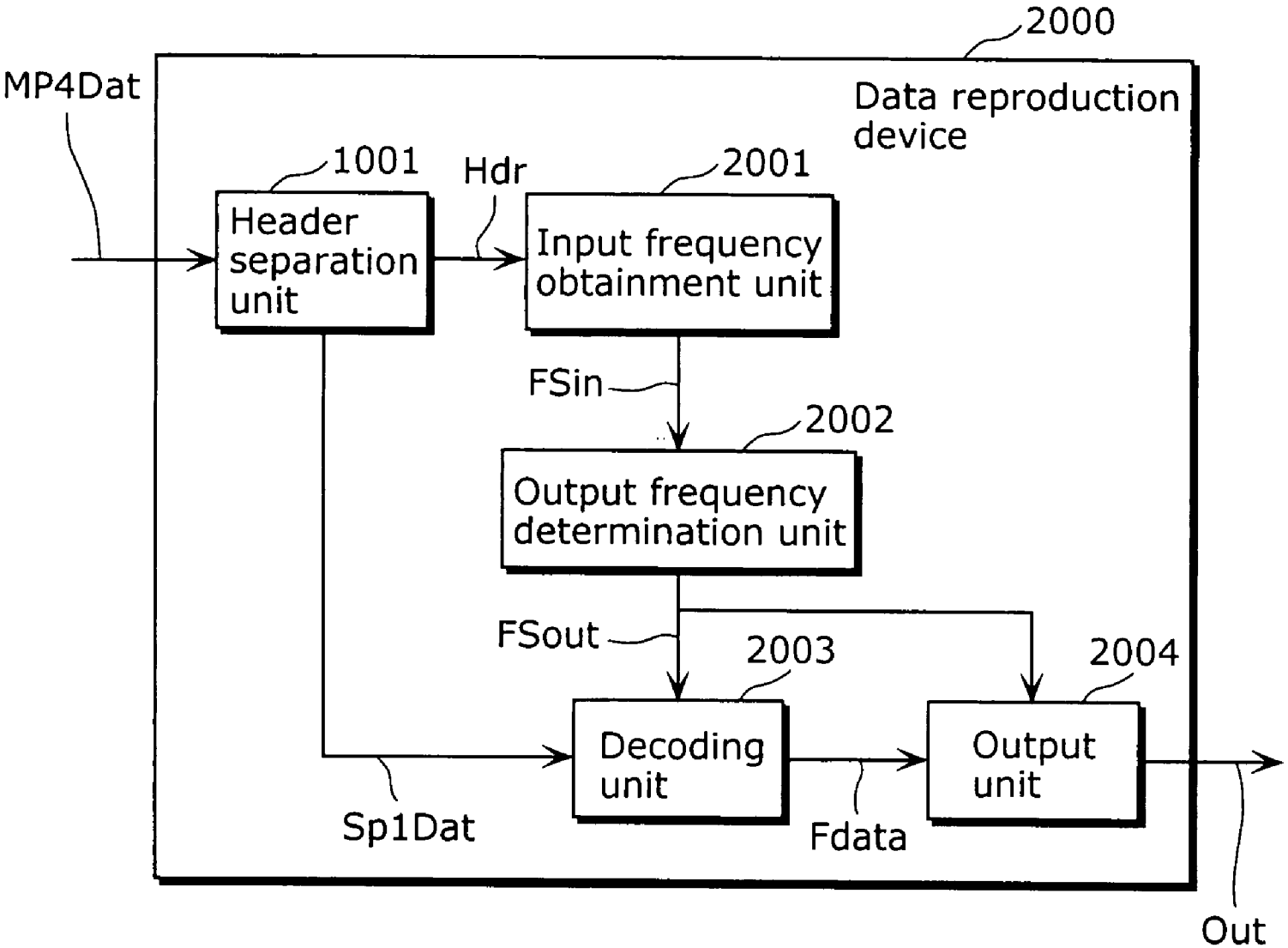
FIG. 9 is a block diagram showing a configuration of a data reproduction device in the first embodiment of the present invention.

FIG. 9 is a block diagram showing a configuration of a data reproduction device 2000 in the first embodiment of the present invention. The data reproduction device 2000 is a device which demultiplexes AAC-plus sample data from an MP4 file including an input AAC-plus track, and decodes and reproduces the sample data. The data reproduction device 2000 includes a header separation unit 1001, an input frequency obtainment unit 2001, an output frequency determination unit 2002, a decoding unit 2003 and an output unit 2004. Note that the audio coding format in the present invention is not limited to AAC or AAC-plus, and it may be AC3, MP3, or any other format having a bandwidth extension function additionally to such coding formats, or may include plural audio tracks. Reproduction processing of only an audio track is described hereinafter, and a description of reproduction processing of a video track is omitted. However, as a coding format of a video track, MPEG-4 AVC used for digital terrestrial broadcasting for mobile devices, or any other coding format such as MPEG-4 Visual, H.263, VC-1 (a coding format standardized by SMPTE), or the like may be used. In addition, any format may be used for a multiplexing format as long as it is a format in which AAC or AAC-plus coded data can be stored. For example, Advanced Systems Format (ASF:

a format developed by Microsoft Corporation) or Quick Time (a format developed by Apple Computer Inc.) may be used, or TS may be recorded as it is. When recording a TS, the TS may be recorded together with header information or the like which is referred to when reproducing the TS or transferring the recorded TS to an external device in accordance with the standard such as IEEE 1394. Here, the information which is referred to when reproducing the TS includes the address position, the reproduction time, and the like of a randomly-accessible frame.

The difference between the present invention and the conventional data reproduction device 1000 is that the former decodes sample data Sp1Dat so that the sampling frequency of decoded frame Fdata is kept constant even at the switching positions of the validity of the SBR function. The following description mainly focuses on the differences in the processes between the present invention and the conventional data reproduction device.

The input frequency obtainment unit 2001 analyzes the header information Hdr, obtains the input frequency (basic sampling frequency) FSin which is the frequency of the basic data, and outputs it to the decoding unit 2002. The output frequency determination unit 2002 performs predetermined processing based on the input frequency FSin, determines the output frequency (output sampling frequency) FSout which is the sampling frequency of the decoded frame Fdata, and outputs it to the decoding unit 2003 and the output unit 2004. The decoding unit 2003 decodes the sampling data Sp1Dat, and upsamples the decoding result of Sp1Dat if necessary so as to match the sampling frequency of the decoded frame Fdata to FSout. If the SBR function is valid in a frame to be decoded, then the decoding unit 2003 obtains SBR data (bandwidth extension information), and performs bandwidth extension through SBR processing on the decoding result of the basic data decoded at the input frequency FSin so as to match the sampling frequency to the output frequency FSout. The output unit 2004 outputs the decoded frame Fdata at the frequency which is identical to the output frequency FSout. Here, the output unit 2004 can obtain the output frequency FSout prior to the input of the decoded frame Fdata.

Figure 10:
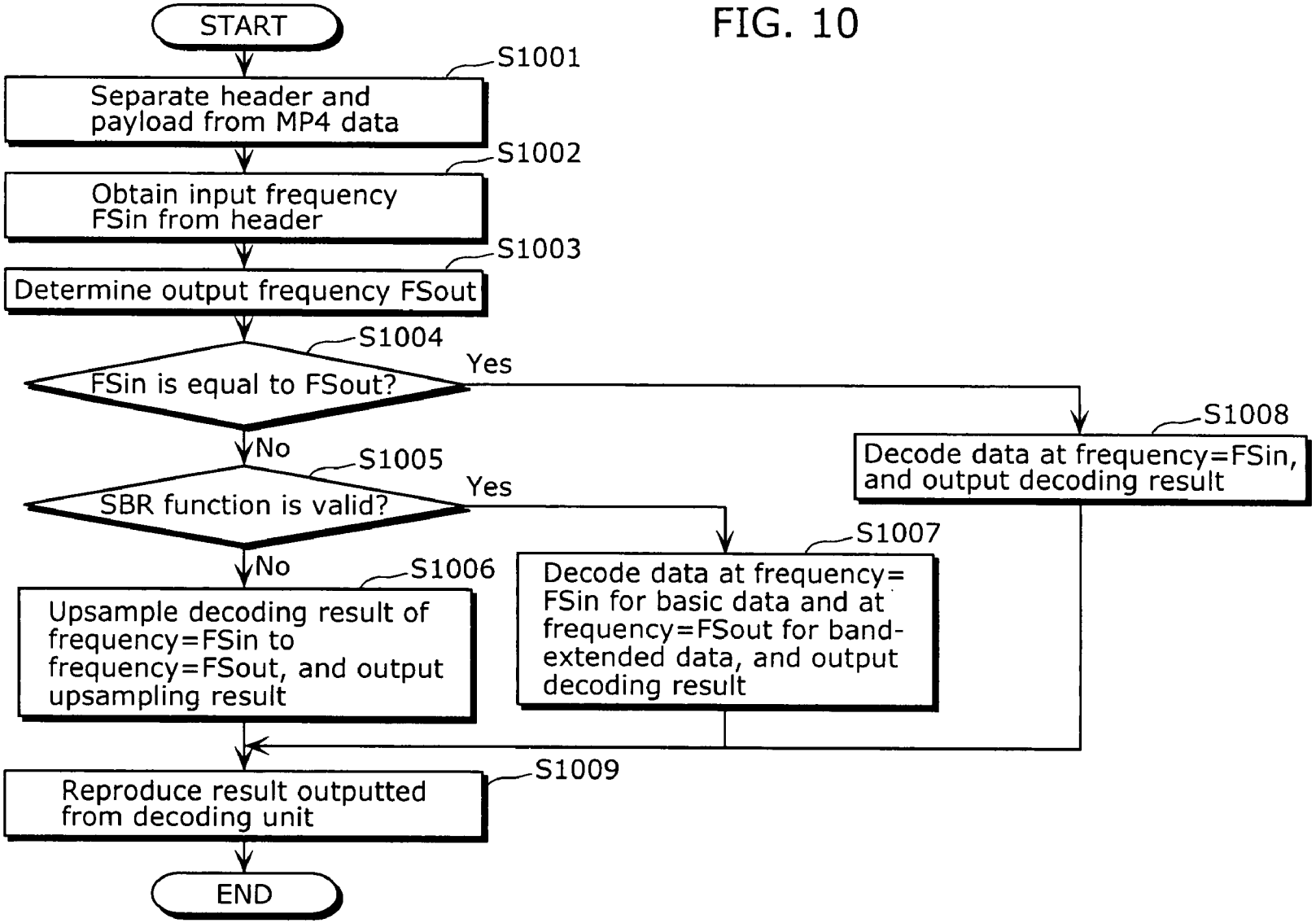
FIG. 10 is a flowchart showing an outline of operations of the data reproduction device according to the first embodiment of the present invention.

FIG. 10 is a flowchart showing operations of the data reproduction device 2000. First, in Step 1001, the header separation unit 1001 separates the header and the payload from the input MP4 file data, and then the process goes to Step 1002. Here, the header means "ftyp", "moov", "moof" or the like, and the payload means "mdat". In Step 1002, the input frequency obtainment unit 2001 analyzes the header and obtains the input frequency FSin. Next, in Step 1003, the output frequency determination unit 2002 determines the output frequency FSout based on the input frequency FSin obtained by the input frequency obtainment unit 2001. Next, in Step 1004, it is judged whether or not the input frequency FSin is equal to the output frequency FSout, and if they are equal to each other, the process goes to Step 1008, while if they are different, the process goes to Step 1005. In Step 1005, the decoding unit 2003 judges whether or not the SBR function is valid in a frame to be decoded, and if it is valid, the process goes to Step 1007, and if it is not valid, the process goes to Step 1006. In Step S1006, the decoding unit 2003 decodes the sample data at the input frequency FSin, and upsamples the decoding result to the output frequency FSout, and then the process goes to Step 1009.

Here, the processing for determining the output frequency FSout in Step 1003 may be performed only when the reproduction starts.

Furthermore, the processing in Step 1002 and Step 1004 may also be performed when necessary. For example, in MP4, an input frequency FSin can be changed per sample entry, but the input frequency FSin is constant in a track if only one sample entry is included in the track. Therefore, Step 1002 and Step 1004 need to be performed only when reproduction of the track starts. On the other hand, in the case where an input frequency FSin is attached to each AAC-plus frame, for example, an AAC-plus stream stored in an ADTS frame is carried by a TS, Step 1002 and Step 1004 may be performed per frame. In this case, the processing for separating the header and the payload of the ADTS frame corresponds to Step 1001. Also, when TS-packetized AAC or AAC-plus data is reproduced, Step 1002 and Step 1004 may be performed per specified unit of switching the input frequency FSin if the unit is specified by separately obtained information.

Note that as for whether the SBR function is valid or not in a sample, the input frequency obtainment unit 2001 may determine it, or the output frequency 2002 may determine it by analyzing the header information Hdr, or the decoding unit 2003 may determine it by analyzing the sample data. If it is obtained from the header information Hdr, information of a sample entry in a track where the AAC-plus coded data is stored can be used. If whether SBR is valid or not is indicated in AAC-plus coded data by a brand or the like of an MP4 file, such information may be used.

In Step 1007, the decoding unit 2003 performs bandwidth extension through SBR processing of the decoding result of the basic data decoded at the input frequency FSin, so as to match the sampling frequency to the output frequency FSou, and the process goes to Step 1009. In Step 1008, the decoding unit 2003 decodes the sample data at the input frequency FSin, and the process goes to Step 1009. Finally, in Step 1009, the output unit 2004 reproduces the result outputted from the decoding unit obtained in each of Step 1006, Step 1007 and Step 1008.

Note that if the frequency of the basic data is fixed in accordance with the standard or in the actual operation, the processes in Step 1004 and Step 1008 may be omitted.

Figure 11:
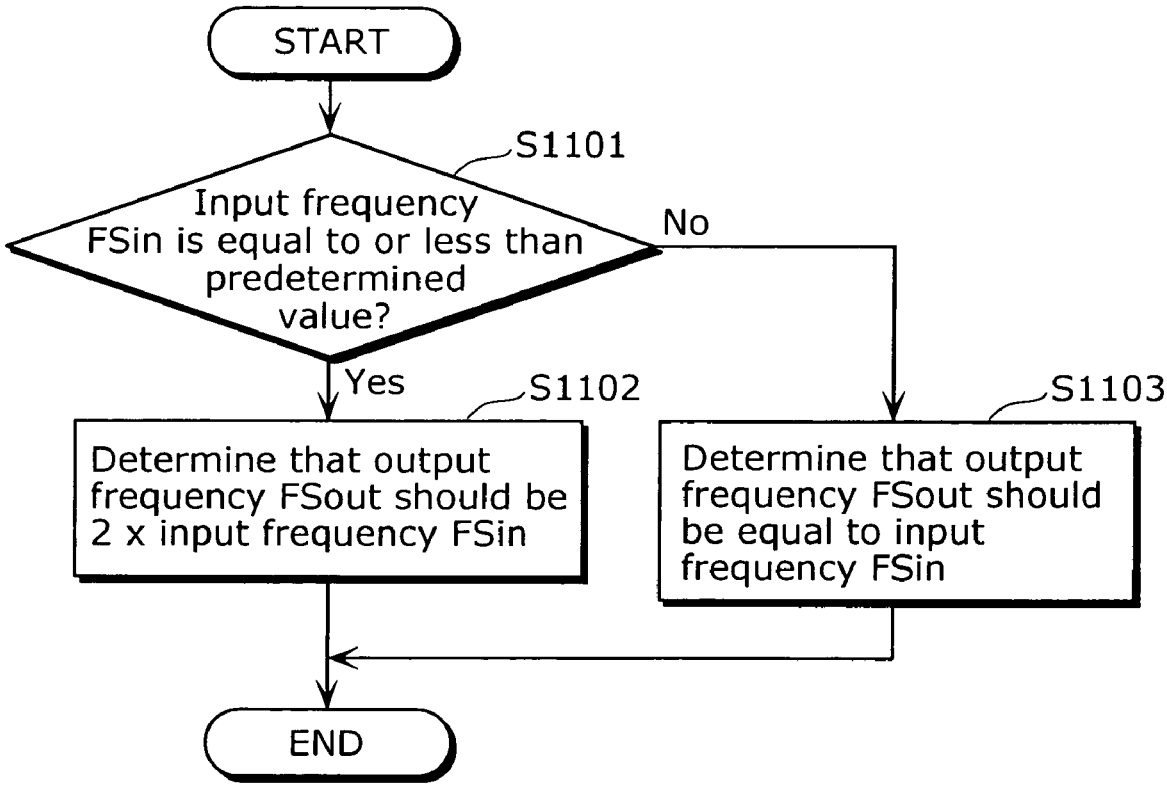
FIG. 11 is a flowchart showing operations for determining a sampling frequency of an output frame in the data reproduction device according to the first embodiment of the present invention.

Next, an operation for determining the output frequency FSout in Step 1003 is described with reference to FIG. 11. First, in Step 1101, the output frequency determination unit 2002 judges whether the input frequency FSin is equal to or less than a predetermined value, and when it is the predetermined value or less, the process goes to Step 1102, while when it exceeds the predetermined value, the process goes to Step 1103. In Step 1103, the output frequency determination unit 2002 determines that the output frequency FSout should be equal to the input frequency FSin. In Step 1102, the output frequency determination unit 2002 determines that the output frequency FSout should be double the input frequency FSin. Here, the output frequency should be double the input frequency because the bandwidth is doubled in the SBR bandwidth extension processing. Note that in the data reproduction device 2000 in the present embodiment, the above-mentioned predetermined value in Step 1101 is set to 24 kHz. This is for the following reason. In the digital terrestrial broadcasting for mobile devices which has been standardized by the Association of Radio Industries and Businesses (ARIB) and is expected to be implemented in Japan (hereinafter referred to as one-segment broadcasting), the AAC sampling frequency is one of 24 kHz and 48 kHz. Therefore, in the case where the sampling frequency is 24 kHz, by upsampling the sampling frequency to 48 kHz and outputting this, the output frequency can always be kept at 48 kHz. In one-segment broadcasting, the sampling frequency is fixed to 24 kHz if the SBR function is valid.

Note that in Step 1101, the processing may be switched based on whether the input frequency is a predetermined value or not. In addition, in Step 1103, the output frequency FSout may be set to a value different from a value double the input frequency FSin, or may be set to a predetermined value. Furthermore, the predetermined value in Step 1101 may be a value other than 24 kHz, depending on a service.

Figure 8:
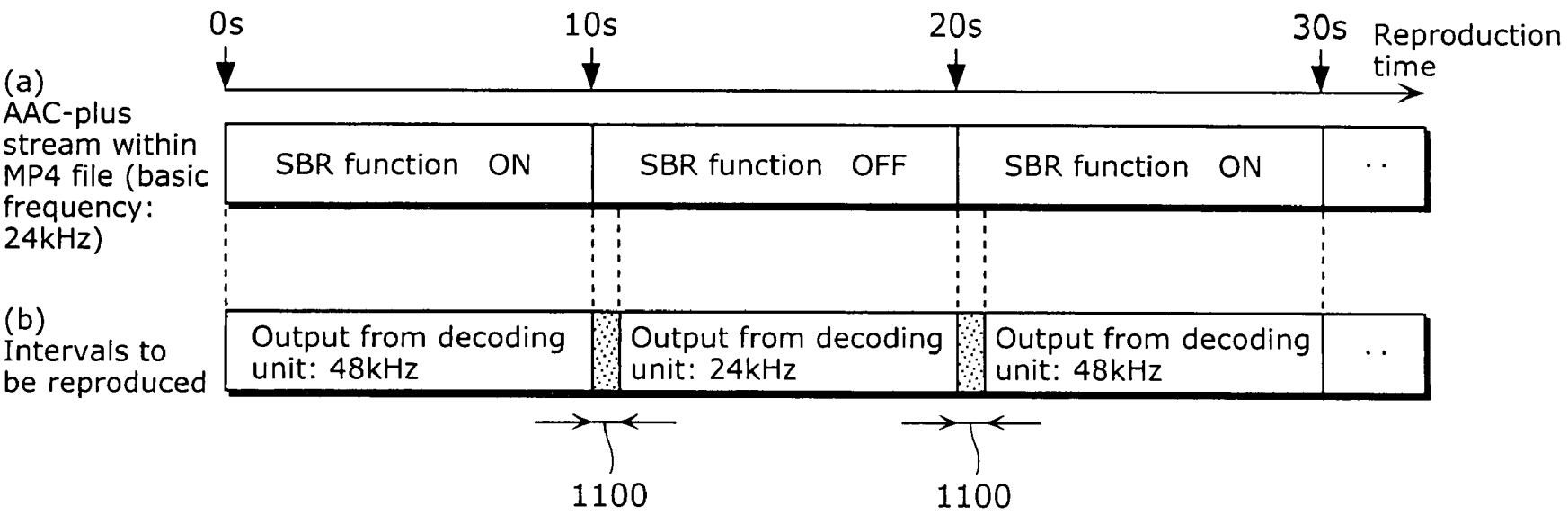
FIG. 8 is a diagram showing a problem of a conventional data reproduction device.
Figure 12:
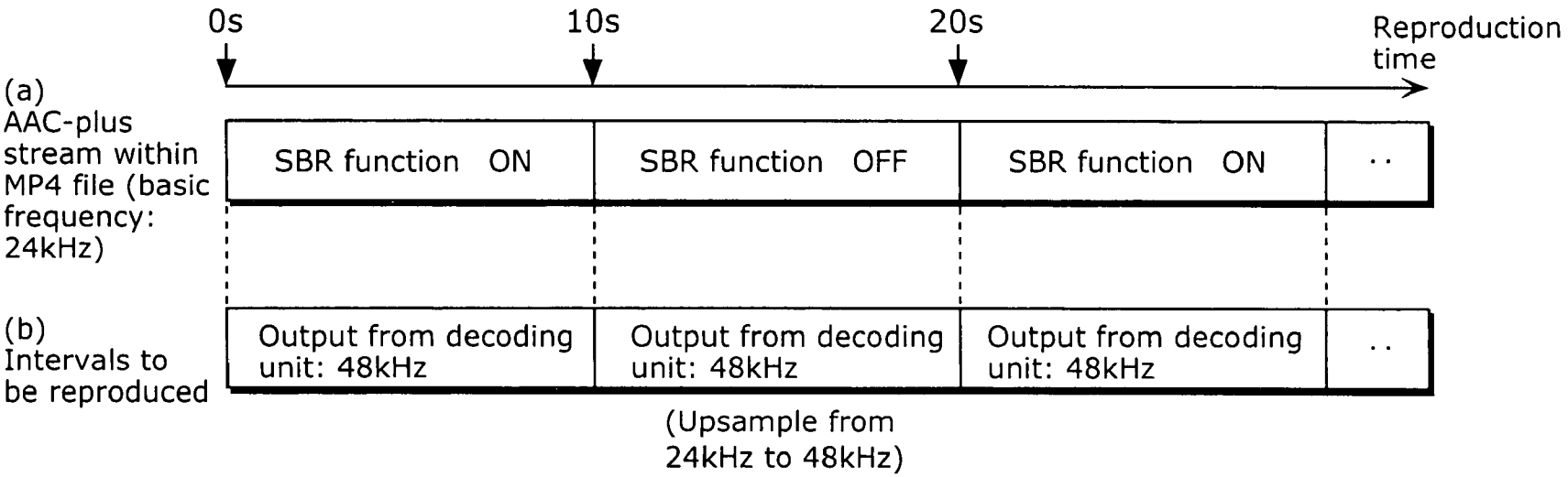
FIG. 12 is a diagram showing an example of a reproduction of an MP4 file in the data reproduction device according to the first embodiment of the present invention.

FIG. 12 is a diagram showing a change in reproduction state in which the data reproduction device 2000 is reproducing the MP4 file same as that in FIG. 8. The lower part of FIG. 12 shows the sampling frequency of a decoded frame Fdata outputted from the decoding unit 2003 when an MP4 file as shown in the upper part of FIG. 12 is being reproduced. Since the input frequency FSin which is the sampling frequency of the basic data is kept at 24 kH across the entire interval from 0 to 30 seconds, the output frequency FSout is set to 48 kHz which is a double of 24 kHz in Step 1103. As a result, the output frequency FSout is kept constant at 48 kHz. Therefore, unlike the conventional data reproduction device 1000 as shown in the lower part of FIG. 8, the sampling frequency is not switched at the positions of reproduction time of 10 seconds and 20 seconds, and thus seamless reproduction can be realized.

An application of the operations of the above-described data reproduction device 2000 is described hereinafter.

Figure 13:
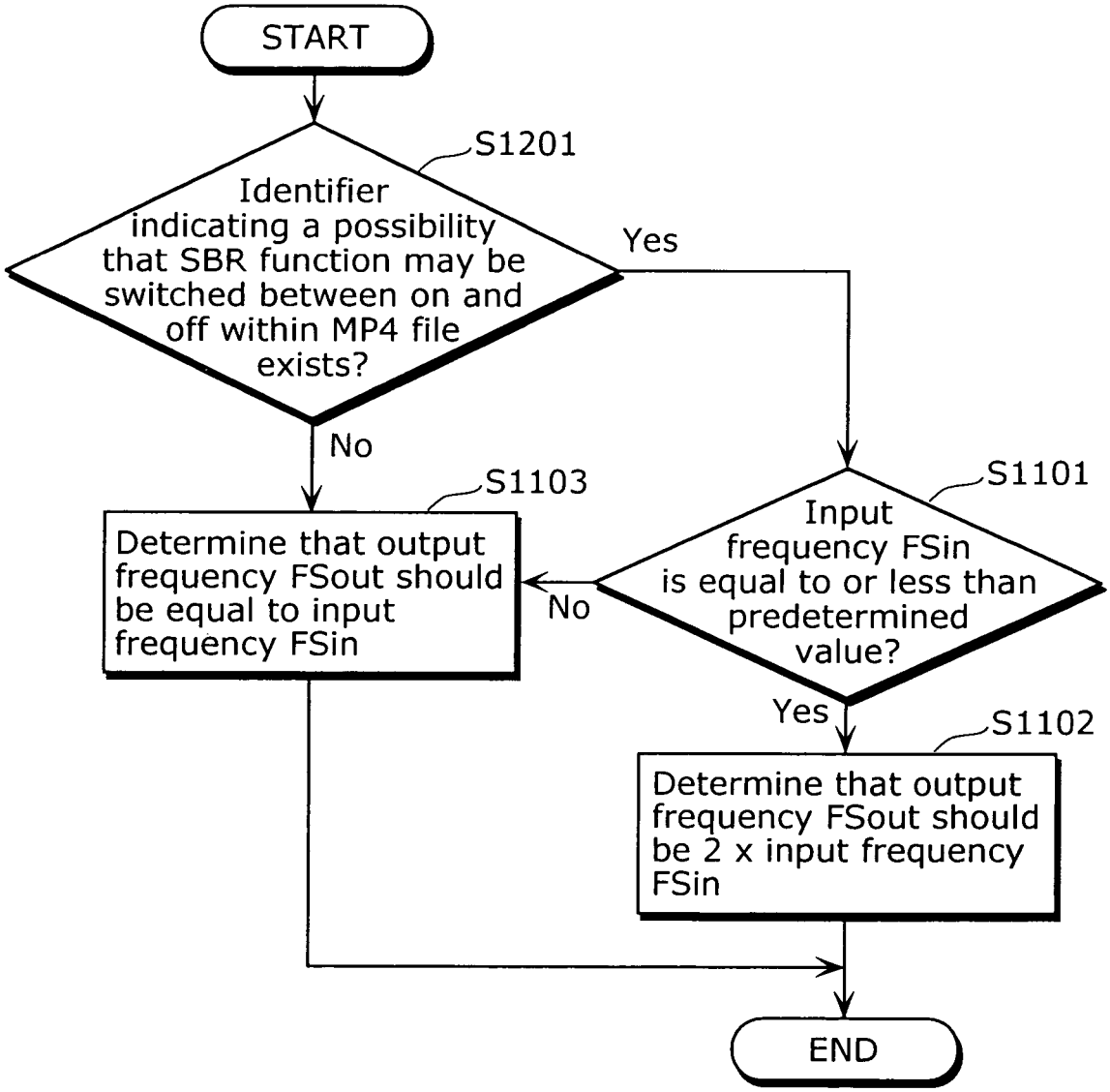
FIG. 13 is a flowchart showing operations for determining the sampling frequency of an output frame based on header information other than the sampling frequency in the data reproduction device according to the first embodiment of the present invention.

MP4 is adopted in various operational standards, but in some operational standards, it is fixed whether SBR can be validated or not on an AAC-plus track stored in an MP4 file. More specifically, if SBR can be validated, the validity of the SBR function may be switched within a track, but if SBR is invalid, the SBR function is invalid in all the frames within the track. FIG. 13 is a flowchart showing example operations for switching the processing for determining the output frequency FSout based on whether or not SBR can be validated in all the frames within a track. In Step 1201, it is judged whether or not an identifier exists indicating a possibility that the validity of the SBR function may be switched on a track within an MP4 file, and if the identifier exists, the process goes to Step 1101, while if the identifier does not exist, the process goes to Step 1103. It is possible to use, as an identifier used in Step 1201, information indicating that an AAC or AAC-plus track recorded in an MP4 file is data on which one-segment broadcast is recorded. If the fact that the track is the data on which one-segment broadcast is recorded is indicated, the process goes to Step 1101. Note that identification information may be a brand indicated in "ftyp", or may be stored in another Box present in "moov" or "moof". For example, since a Box called "sdvp" is defined independently in the SD standard, the information that the track is the data on which one-segment broadcast is recorded may be shown in the Box. The brand in "ftyp" may be either "compatible-brand" or "major-brand". A list of brands with which an MP4 file has compatibility is shown in "compatible-brand", and a brand with the highest compatibility with the MP4 file is shown in "major-brand". Or, the identification information may be notified using information different from the MP4 file.

Note that the processing for determining the output frequency FSout in Step 1003 may be switched based on an identifier indicating attribute information of an MP4 file such as a brand.

Figure 14:
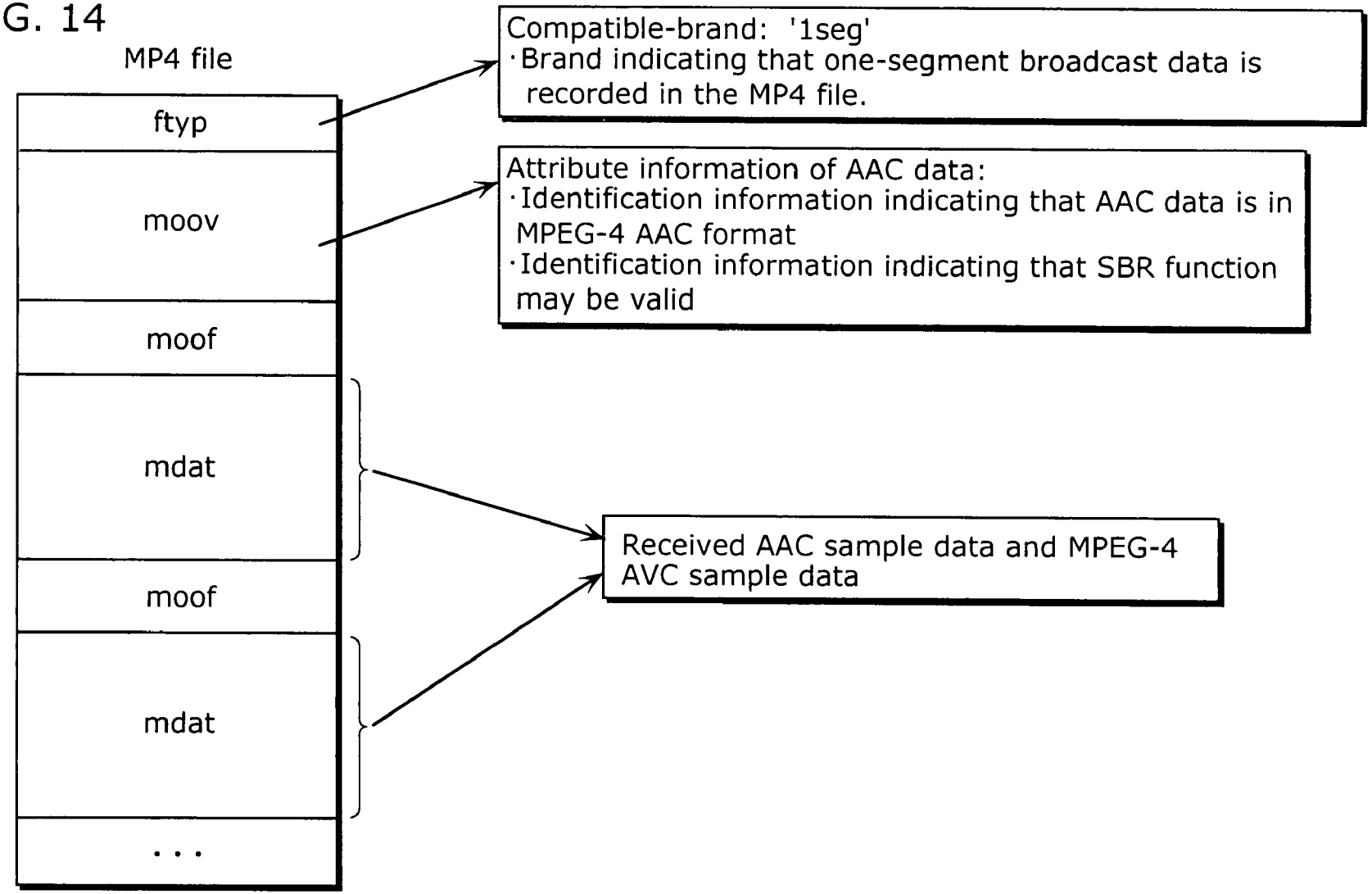
FIG. 14 is a diagram showing a structure example of an MP4 file to be inputted in the data reproduction device according to the first embodiment of the present invention.

FIG. 14 is a diagram showing an example of an MP4 file in which one-segment broadcast data is recorded. A "1seg" brand is included in "compatible-brand" in "ftyp", and by detecting the "1seg" brand, it can be judged that the MP4 file includes one-segment broadcast data. Furthermore, in the MP4 file of FIG. 14, MPEG-2 AAC data of one-segment broadcasting is recorded as MPEG-4 AAC data in order to make the coding format of the track in the MP4 file compliant with the operational standard for the third-generation devices such as 3GPP. By doing so, even a terminal which is compliant with only MPEG-2 AAC as an AAC coding format can judge that the coded data itself is compliant with MPEG-2 AAC and thus reproduce it, if "ftyp" includes a "1seg" brand. In addition, since the coding format is compliant with the operational standards for the third-generation mobile terminals, the MP4 file can be reproduced even in the third-generation mobile terminals which can decode the data which satisfies the audio and video coding conditions in the one-segment broadcasting standards. Here, the above-mentioned coding conditions are the sampling frequency, the number of channels, the bitrate, and the like for audio, and the image size, the bitrate, and the like for video. The items necessary for recording the data as MPEG-4 AAC data are shown as follows.

First, the information in "moov" indicating the coding format of an audio track indicates that the coding format is MPEG-4 AAC. Furthermore, since it can be indicated whether or not there is a possibility that a sample having a valid SBR function exists in an MPEG-4 AAC track when such a track is stored in an MP4 file, it is indicated in the relevant field that there is a possibility that such a sample having a valid SBR function exists. To be more specific, "sbrPresentFlag" which is a flag indicating whether or not SBR data is included in MPEG-4 AAC coded data is set to "1" or "−1" in a sample entry in "stsd". If "sbrPresentFlag" is "1", it is explicitly indicated that SBR data may be included; while if "sbrPresentFlag" is "−1", it is not explicitly indicated from outside of the coded data whether SBR data is included or not. Therefore, in Step 1201, the process may go to Step 1101 if a "1seg" brand exists in "compatible-brand" in Step 1201, or the process may go to Step 1101 only when the "1seg" brand exists and "sbrPresentFlag" is "1" or "−1". In addition, the process may go to Step 1101 if "sbrPresentFlag" is "1" or "−1". Note that the present invention can be implemented assuming that SBR is always valid when "sbrPresentFlag" is "1".

Figure 15:
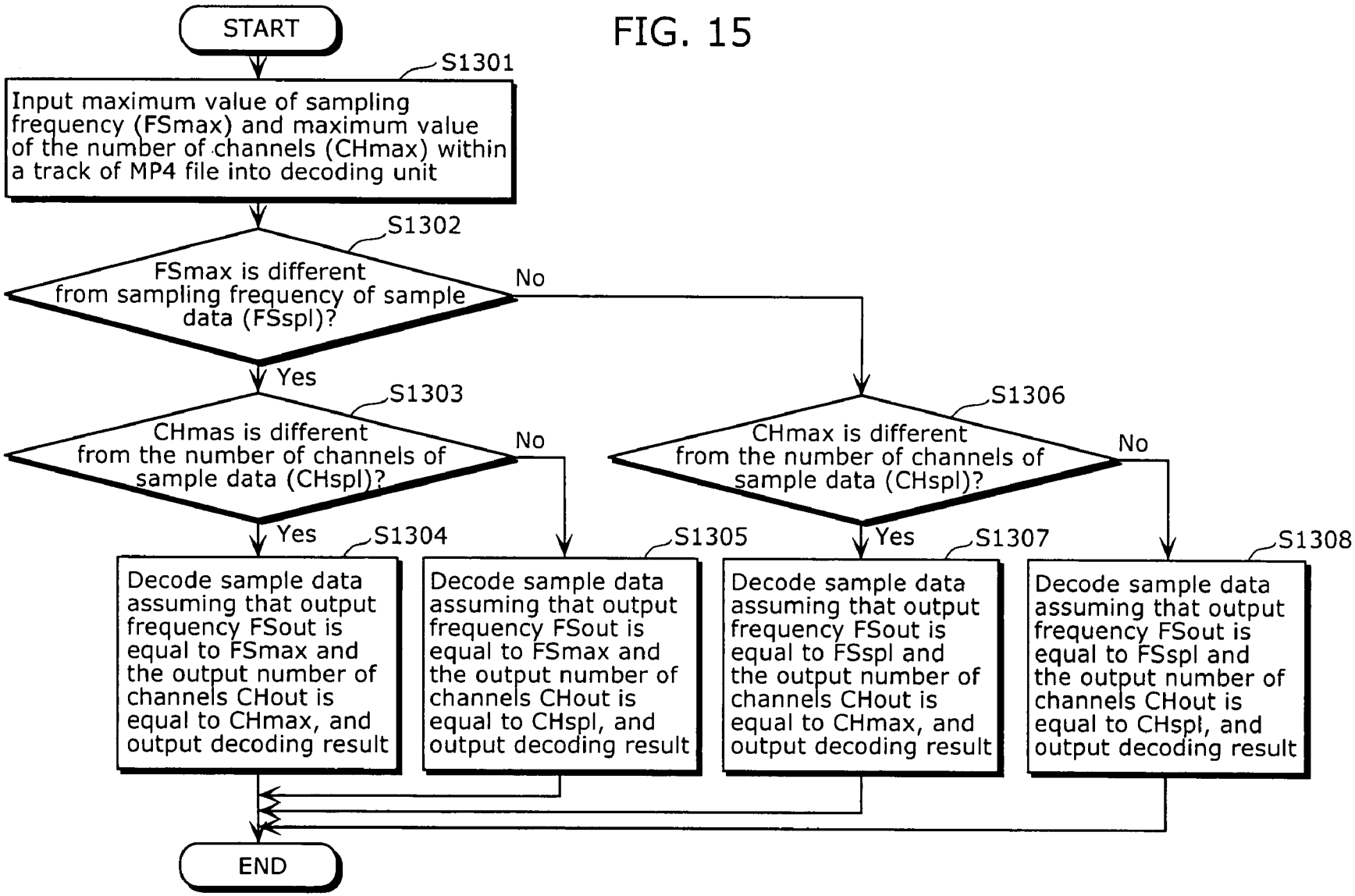
FIG. 15 is a flowchart showing operations for determining the sampling frequency and the number of channels of an output frame, based on the maximum sampling frequency and the maximum number of channels of a frame included in a track, in the data reproduction device according to the first embodiment of the present invention.

FIG. 15 is a flowchart showing another example of operations for keeping the sampling frequency of decoded data Fdata constant. In the above operation, the sampling frequency of AAC-plus basic data and the sampling frequency of an AAC sample are the known values indicated by FSin. In the example of FIG. 15, the sampling frequencies of these input sample data are not known but the maximum values are shown instead, which is different from the above-mentioned operations. For example, this example can be applied to the case where the frequency of AAC coded data is switched between 24 kHz and 48 kHz.

In the following description, it is assumed that the number of channels of decoded data Fdata is kept constant. However, the processing for keeping the output of the decoding unit 2003 constant may be performed for only one of the sampling frequency and the number of channels.

In the input MP4 file, the maximum value FSmax of the sampling frequency and the maximum value CHmax of the number of channels of the sample in an audio track are indicated. It is assumed here that the sampling frequency and the number of channels stored in the sample entry of the audio track respectively indicate the maximum value FSmax of the sampling frequency and the maximum value CHmax of the number of channels.

First, in Step 1301, the audio sample entry is analyzed to obtain the maximum value FSmax of the sampling frequency and the maximum value CHmax of the number of channels, and these values are inputted to the decoding unit 2003. In Step 1302, the decoding unit 2003 judges whether the maximum sampling frequency value FSmas is different from the sampling frequency of a sample FSspl, and if they are different from each other, the process goes to Step 1303, while if they are identical to each other, the process goes to Step 1306. Here, when the SBR function is valid in the sample, the sampling frequency FSspl is assumed to indicate the sampling frequency after the bandwidth extension. In Step 1303, the decoding unit 2003 judges whether the maximum number of channels value CHmas is different from the number of channels of the sample CHspl, and if they are different from each other, the process goes to Step 1304, while if they are identical to each other, the process goes to Step 1305. In Step 1304, first, the decoding unit decodes the sample data assuming that the sampling frequency is FSspl and the number of channels is CHspl. Then, as for the decoding result, the decoding unit upsamples the sampling frequency to the maximum sampling frequency value FSmax, converts the number of channels into the maximum number of channels value FSmax, and then outputs them. Here, for example, when monaural sound is converted into stereo sound, the number of channels is converted in such a manner that one channel is converted into two channels of stereo data, both of which are made up of the identical data. On the other hand, in Step 1305, first, the decoding unit decodes the sample data assuming that the sampling frequency is FSspl and the number of channels is CHspl. Then, as for the decoding result, the decoding unit upsamples the sampling frequency to the maximum sampling frequency value FSmax but does not convert the number of channels CHspl, and outputs them.

Furthermore, in Step 1306, the decoding unit 2003 judges whether the maximum number of channels value CHmax is different from the number of channels of the sample CHspl, as in Step 1303, and if they are different from each other, the process goes to Step 1307, while if they are identical to each other, the process goes to Step 1308. In Step 1307, first, the sample data is decoded assuming that the sampling frequency is FSspl and the number of channels is CHspl. Then, as for the decoding result, the decoding unit does not upsample the sampling frequency but converts the number of channels CHspl to the maximum number of channels value FSmax, and outputs them. On the other hand, in Step 1308, the decoding unit decodes the sample data assuming that the sampling frequency is FSspl and the number of channels is CHspl, and outputs them. In other words, the output frequency FSout is identical to the sampling frequency FSspl of the sample, and the output number of channels CHout is identical to the number of channels CHspl of the sample.

Note that the maximum sampling frequency value FSmax and the maximum number of channels value CHmax may be stored in a place other than a sample entry, by providing a special Box, for example.

Note that although one-segment broadcast has been described above, the AAC or AAC-plus coded data to be received is not limited to one-segment broadcast, and it may be the data received via the Internet. Furthermore, the above-mentioned method can be applied to the case where packet data received via broadcasting or the Internet is reproduced and then recorded.

In addition, a recording medium is not limited to an SD card, and it may be other nonvolatile memory, a hard disk, and the like.

A method has been described for keeping the output sampling frequency or the output number of channels constant, and thus preventing degradation of reproduction quality such as interrupted reproduction, noise, and the like, which may occur when these parameters are switched. Other methods for preventing degradation of reproduction quality are described hereinafter.

A first method can reduce acoustic discomfort by using a special effect at the parameter-switching position. For example, if sound volume is gradually decreased before the parameter-switching position while it is gradually increased after the switching position so that the sound volume becomes low at the switching position, it is possible to reduce interruption of reproduction and noise. Using this method, the switching position needs to be specified in advance. When a file is reproduced, the switching position can be specified in advance by analyzing the header information of the file. In the case where the switching position can not be specified based on the header information of the file, or when the file is reproduced while receiving data, it is possible to reproduce data of a predetermined number of frames while buffering them so as to judge whether or not the switching position exists in the buffered frames. Furthermore, even if the switching position can not be specified in advance, if the parameter-switching position is detected when the decoding unit decodes a frame, the sound volume of the frame may be decreased and the sound volume of the subsequent frames may be gradually increased.

As a second method, in the case where the sampling frequency is switched only under a specific condition such as a switching position of the number of channels, a file may be reproduced based on the parameters even at the switching position of the sampling frequency and the like. For example, sometimes in broadcasting, only commercial parts are 2-channel while other parts are monaural. This is because contents are discontinuous between a program and a commercial, and therefore there are cases where it can be considered that degradation of reproduction quality caused by the parameter switching is not acoustically noticeable.

Figure 1:
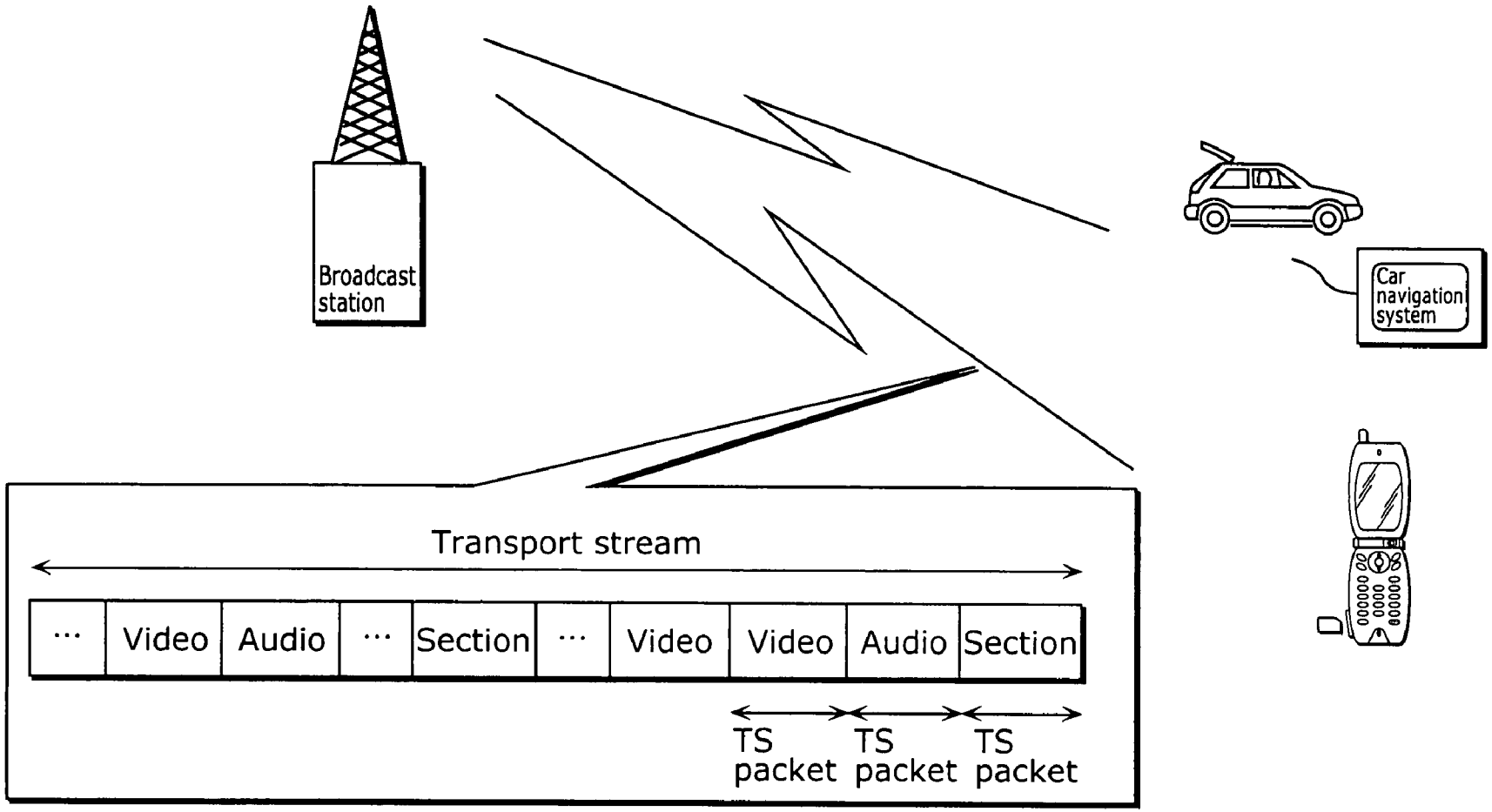
FIG. 1 is a diagram showing an overview of one-segment broadcasting services.
Figure 2:
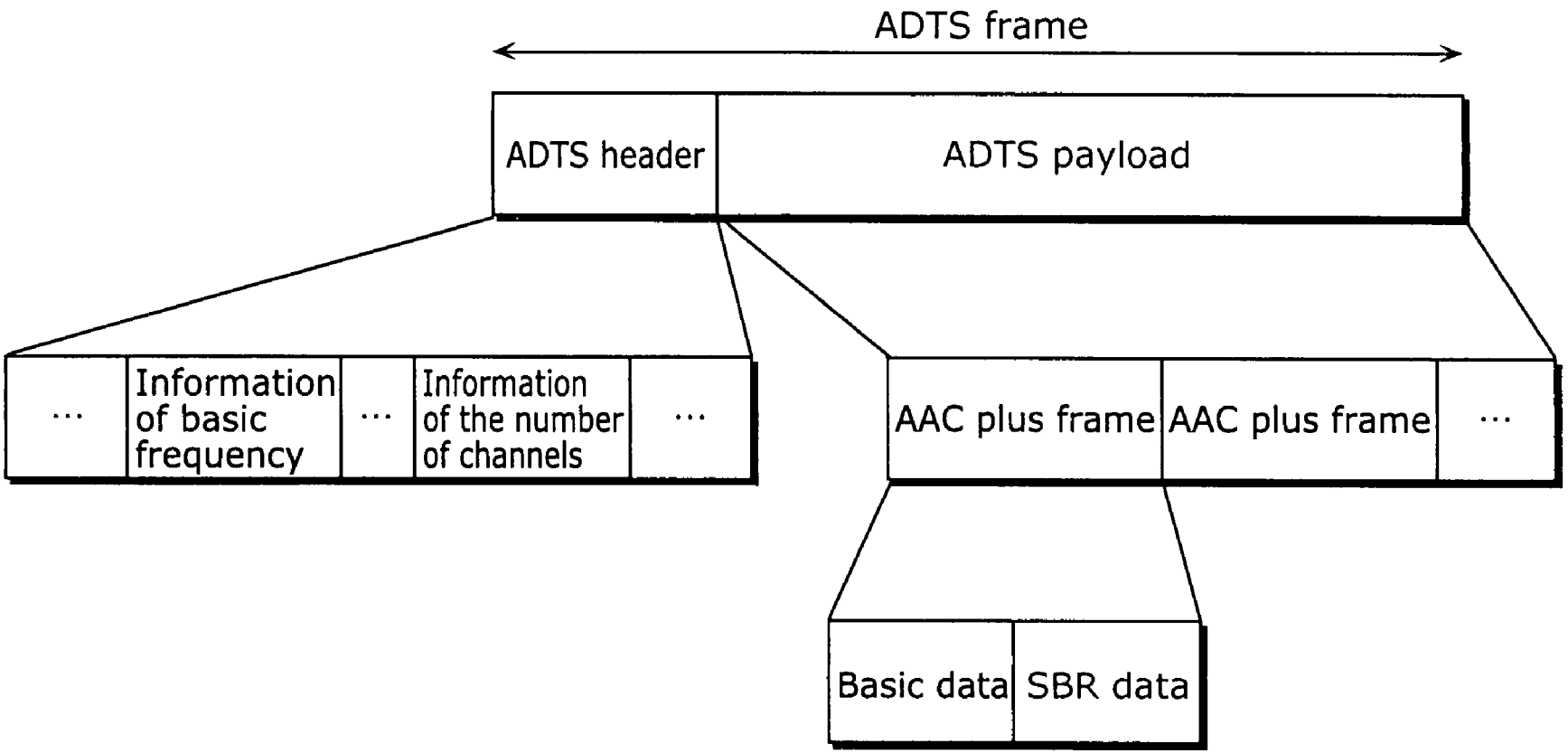
FIG. 2 is a diagram showing a data structure of a conventional ADTS frame.
Figure 4B:
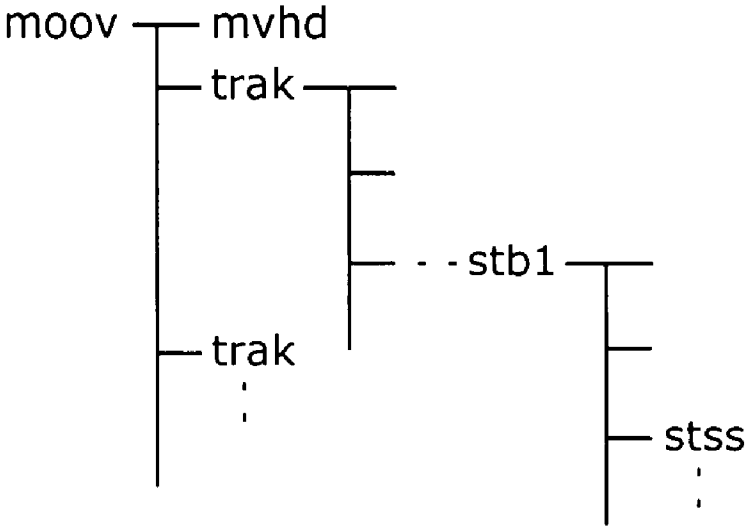
FIG. 4A and FIG. 4B are diagrams showing a hierarchical structure of "moov" in an MP4 file.
Figure 4A:
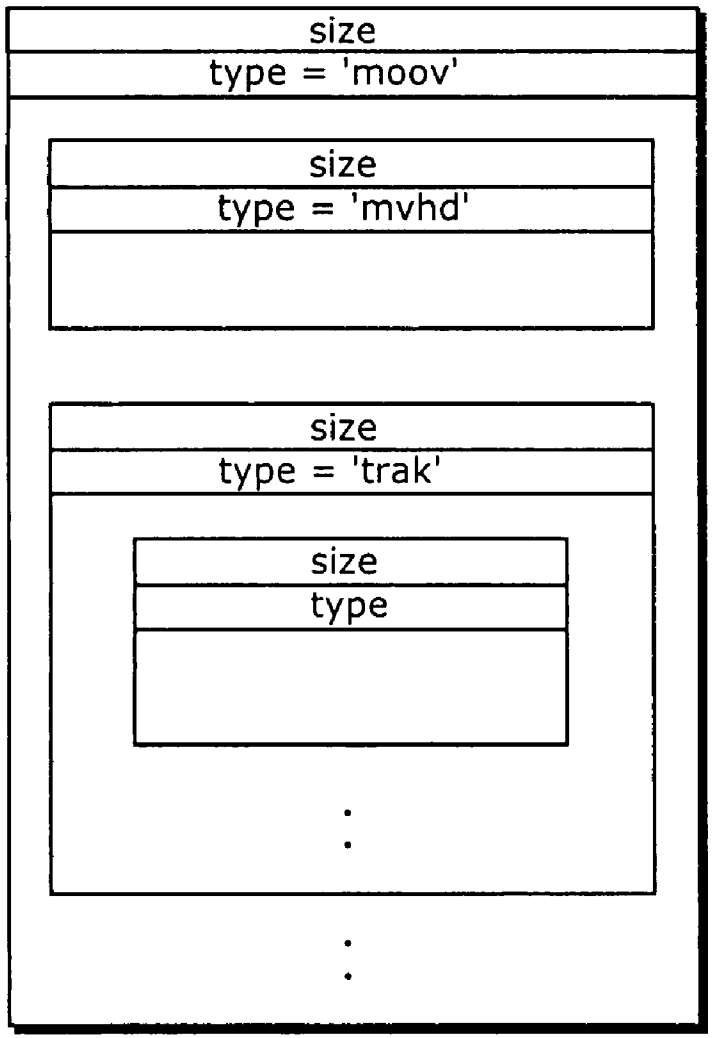
Figure 5:
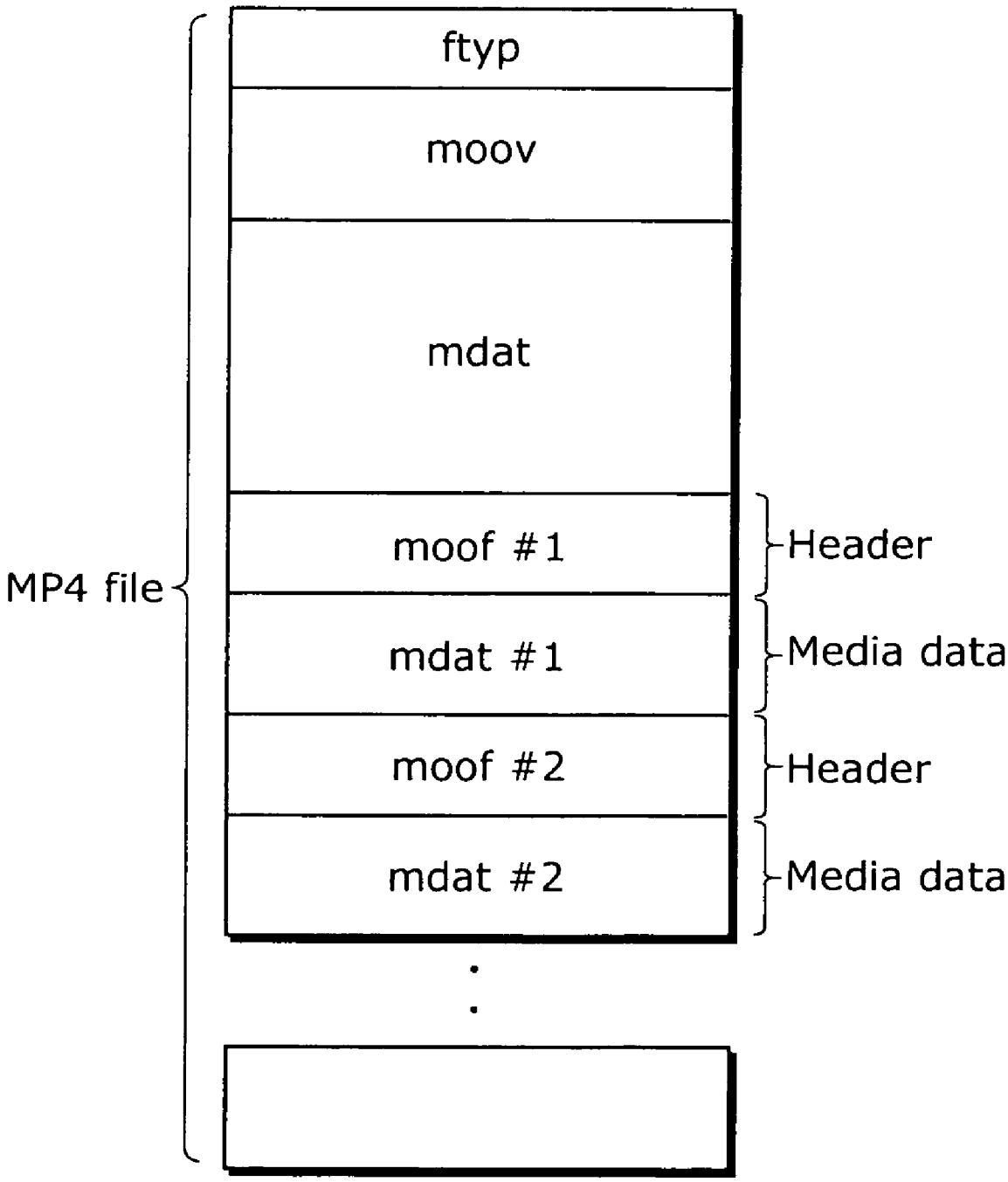
FIG. 5 is a diagram showing how "moof" is used in an MP4 file.
Figure 6:
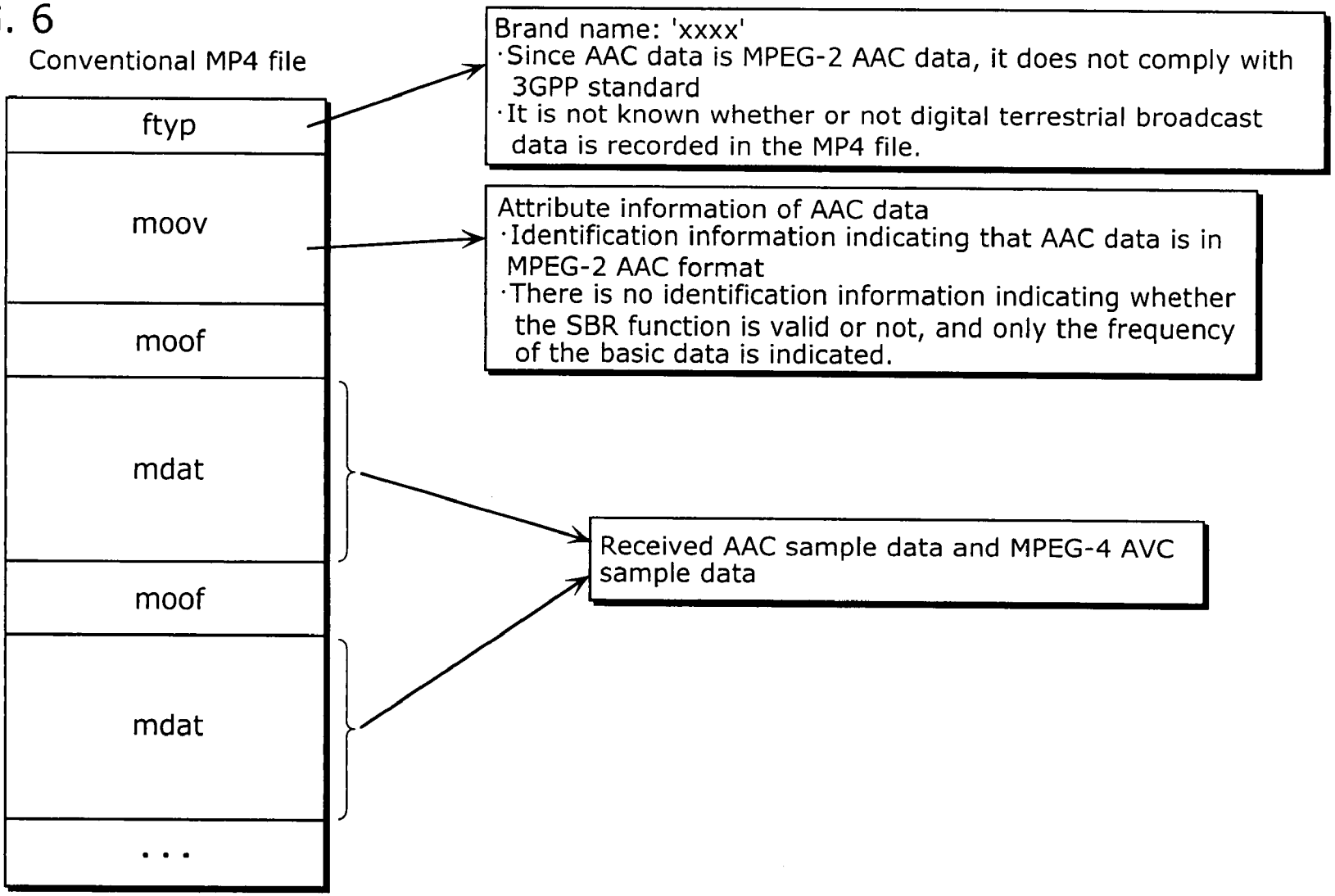
FIG. 6 is a diagram showing a structure example of a conventional MP4 file in which an AAC stream in broadcast data is recorded.
Figure 7:
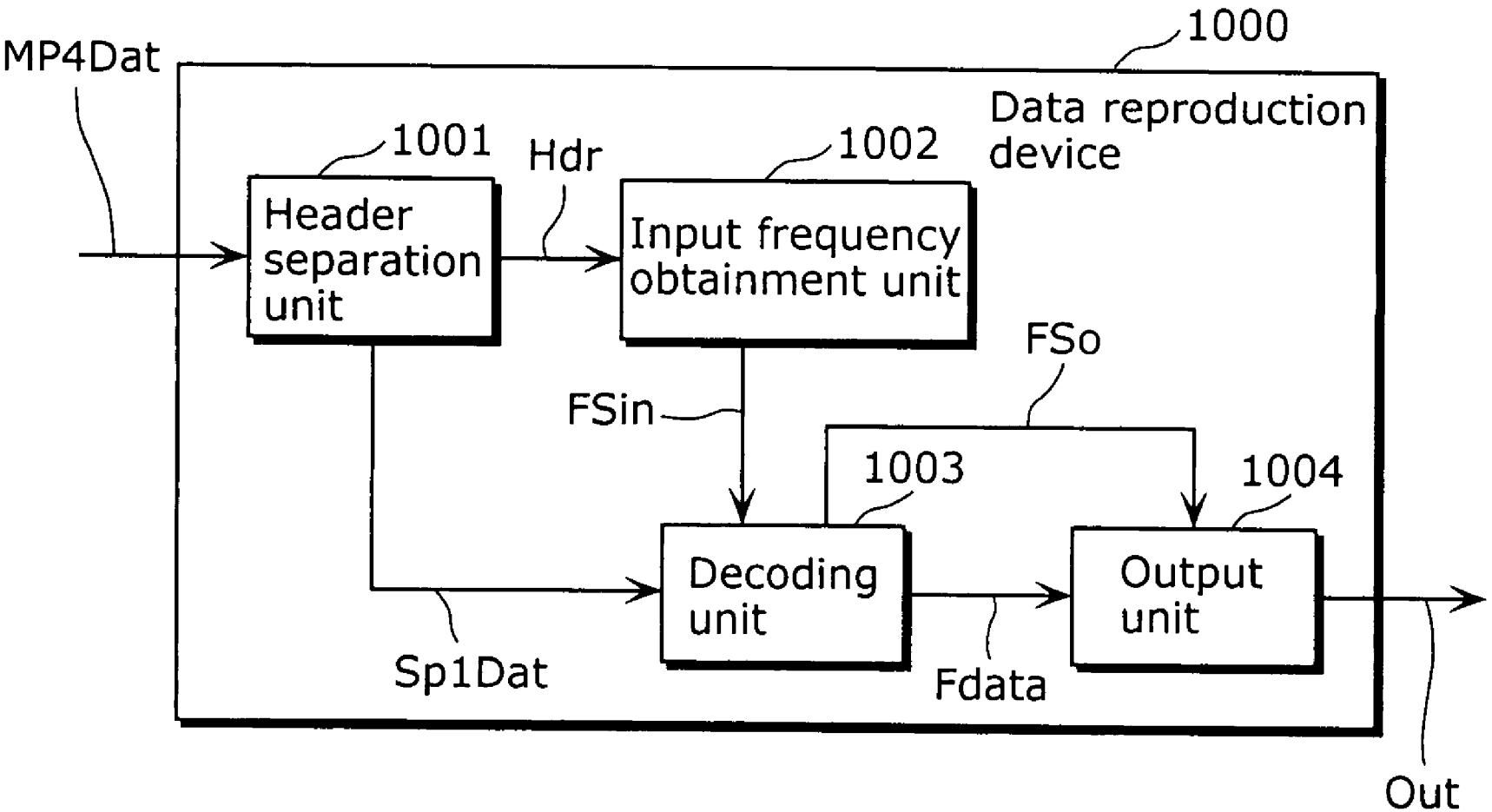
FIG. 7 is a block diagram showing a configuration of a conventional data reproduction device.

Note that the present embodiment has been described taking as an example the case where an MP4 file including an AAC-plus track is inputted to the data reproduction device 2000, but the present invention is not limited to this case. For example, it is also possible to apply the present invention to the case where a TS of MPEG-2 data of one-segment broadcasting is received and reproduced. In this case, the input frequency obtainment unit 2001 has only to obtain the sampling frequency, the number of channels and the like of audio data stored in the payload, from the header of the ADTS frame, as shown in FIG. 2. In the case of AAC-plus, the sampling frequency stored in the ADTS header indicates the sampling frequency of basic data. In addition, it is possible to apply the present invention to the case where the TS of received MPEG-2 data is once recorded and then the recorded MPEG-2 TS is reproduced.

Second Embodiment

Here, a system using the data reproduction device as shown in the above first embodiment is described.

Figure 16:
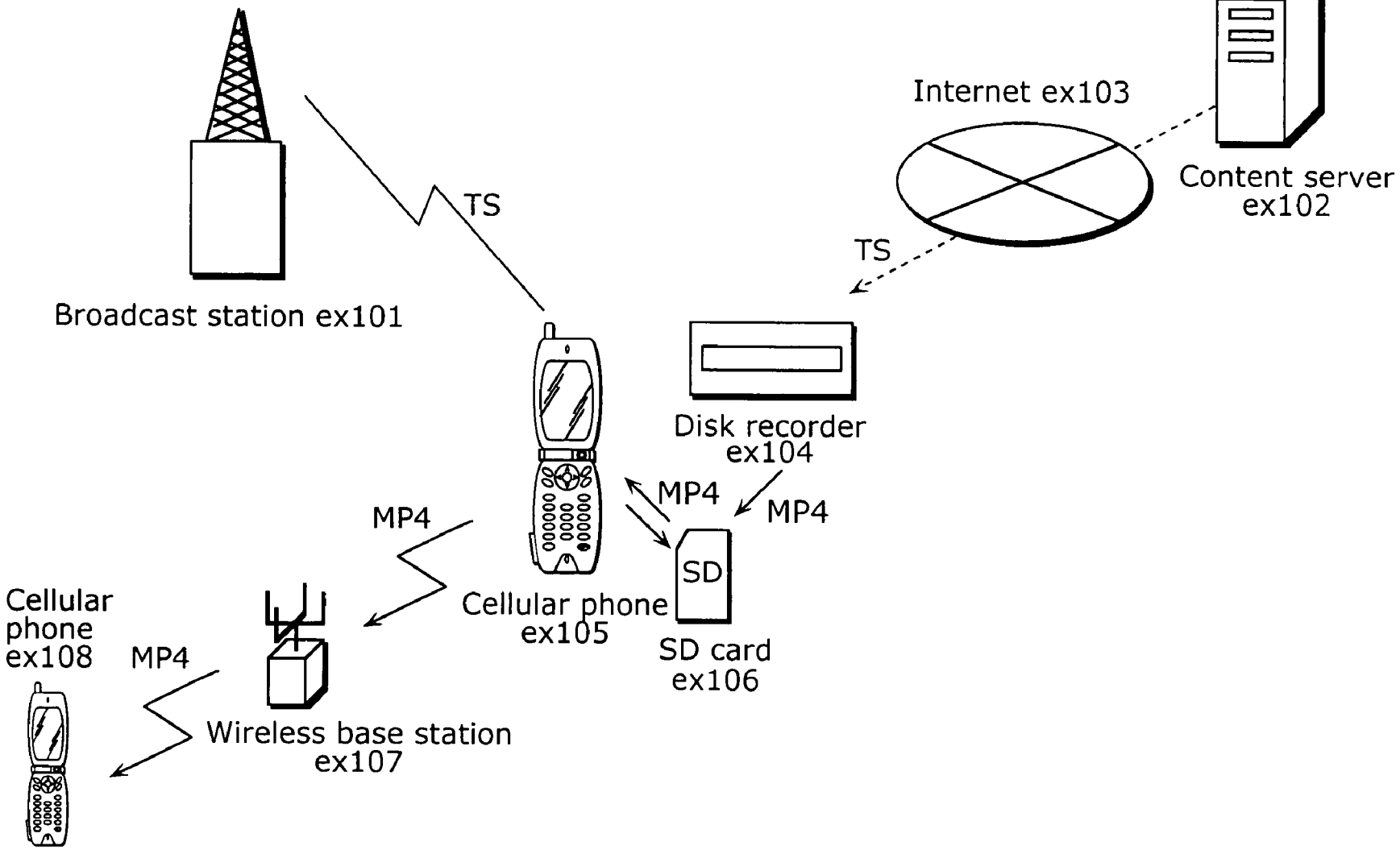
FIG. 16 is a diagram showing examples of services provided using the data reproduction device according to the first embodiment of the present invention.

FIG. 16 is a block diagram showing an overall configuration of a system for implementing contents distribution services via broadcasting and communication. First, the case of receiving broadcast data is described. A cellular phone ex105 or a disk recorder ex104 such as a DVD recorder receives a stream of TS packets (from a Broadcast station ex101) on which digitalized coded media data is multiplexed. The cellular phone ex105 converts the received TS packet stream into an MP4 file and then records it into an SD card ex106. The recorded MP4 file can be viewed and listened to on the cellular phone ex105, the disk recorder ex104 or a personal computer not shown here which includes the data reproduction device of the present invention. It is also possible to transmit an e-mail attached with an MP4 file from the cellular phone ex105 to another cellular phone ex108 which includes the data reproduction apparatus of the present invention, via a wireless base station ex107, and to view and listen to the MP4 file on the cellular phone ex108. It is further possible to download an MP4 file or distribute the MP4 file by pseudo-streaming from the cellular phone ex105 to the cellular phone ex108, using a protocol such as Hyper Text Transport Protocol (HTTP), Transmission Control Protocol (TCP) or the like, instead of attaching the MP4 file to an e-mail.

It is also possible to receive a TS packet stream on the disk recorder ex104, convert it to an MP4 file, and record the file on an optical disk such as an SD card, a DVD or the like, or a hard disk. The recorded MP4 file may be downloaded or distributed by pseudo-streaming to a cellular phone or a personal computer not shown in the diagram.

When a TS packet stream distributed from a content server ex102 via the Internet ex103 is received on the cellular phone ex105 or the disk recorder ex104, an MP4 file can also be used as in the case where the above-mentioned broadcast data is received.

The data reproduction device of the present invention can also be applied to the case where not only a TS but also data transmitted by a protocol such as Real-time Transport Protocol (RTP) used for streaming distribution on the Internet is recorded in MP4 file format.

Third Embodiment

By recording a program for implementing the data reproduction method in the data reproduction device as shown in each of the above-mentioned embodiments, on a recording medium such as a flexible disk and the like, it becomes possible to perform the processing as shown in the above embodiments easily in an independent computer system.

Figure 17A:
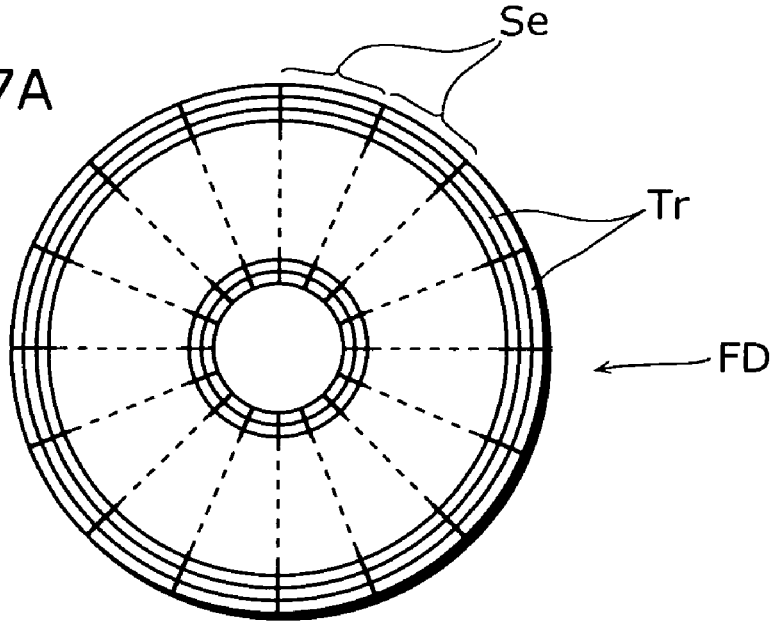
FIG. 17A to FIG. 17C are explanatory diagrams of a storage medium for storing a program for causing a computer system to implement the data reproduction method employed in the data reproduction device in each of the embodiments.
Figure 17B:
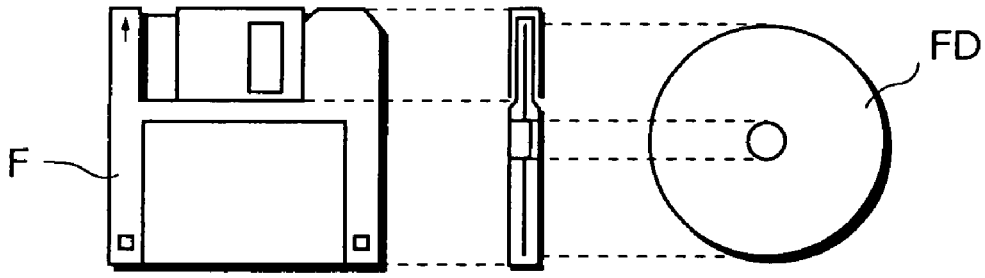
Figure 17C:
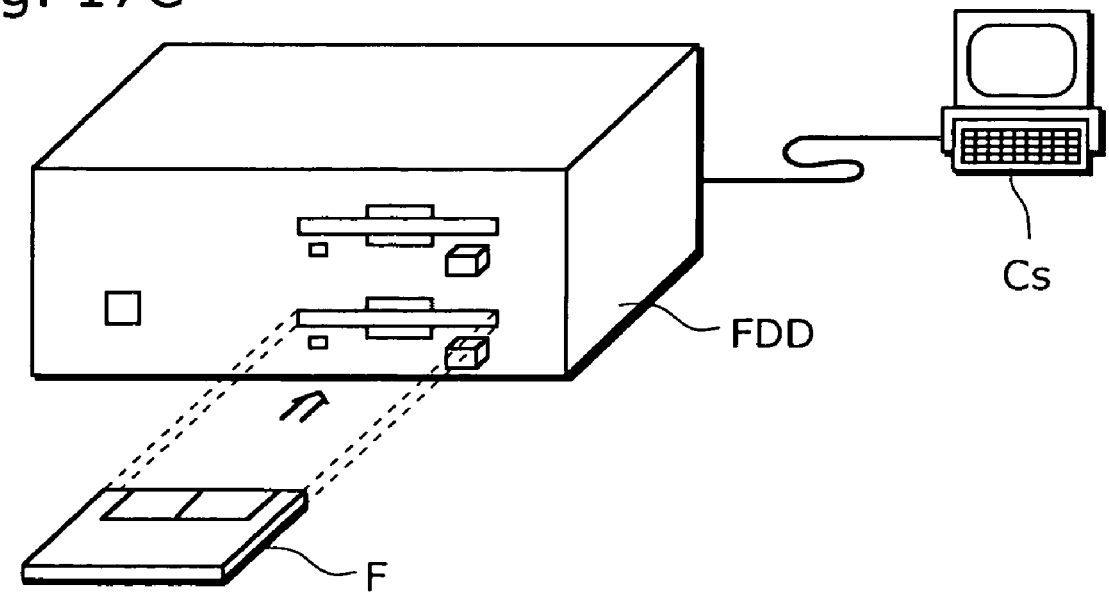

FIG. 17A, FIG. 17B and FIG. 17C are diagrams for explaining the case where the data reproduction method in the data reproduction device in the above embodiments is executed in a computer system using a program recorded on a recording medium such as a flexible disk.

FIG. 17B shows the front view and the cross-section of a flexible disk, as well as the flexible disk itself, whereas FIG. 17A shows an example of a physical format of the flexible disk as a recording medium body. A flexible disk FD is contained in a case F, plural tracks Tr are formed concentrically on the surface of the disk in the radius direction from the periphery, and each track is divided into 16 sectors Se in the angular direction. Therefore, as for the flexible disk storing the above program, the program is recorded in an area allocated for it on the flexible disk FD.

In addition, FIG. 17C shows the configuration for recording and reproducing the program on and from the flexible disk FD included in the case F. When the program for implementing the data reproduction method in the data reproduction device is recorded on the flexible disk FD, the computer system Cs writes the program onto the flexible disk FD via a flexible disk drive. In order to construct, in the computer system, the above data reproduction method in the data reproduction device in each of the above embodiments which are implemented by the program recorded on the flexible disk, the program is read out from the flexible disk via the flexible disk drive and transferred to the computer system.

Note that the above description is made on the assumption that a recording medium is a flexible disk, but the same processing can also be performed using an optical disk. In addition, the recording medium is not limited to these disks, but any other mediums such as an IC card, a ROM cassette, and the like can be used in the same manner if only a program can be recorded on them.

Furthermore, each functional block in the block diagram shown in FIG. 9 is typically achieved in the form of an integrated circuit or an LSI. Each of these functional blocks can be in plural single-function LSIs, or a part or all of these functional blocks can also be in one integrated LSI. (For example, the functional blocks other than the memory may be in one integrated LSI).

The name used here is LSI, but it may also be called IC, system LSI, super LSI, or ultra LSI depending on the degree of integration.

Moreover, ways to achieve integration are not limited to the LSI, and a special circuit or a general purpose processor and so forth can also achieve the integration. Field Programmable Gate Array (FPGA) that can be programmed after manufacturing LSI or a reconfigurable processor that allows re-configuration of the connection or configuration of LSI can be used for the same purpose.

In the future, with advancement in semiconductor technology, a brand-new technology may replace LSI. The integration of the functional blocks can be carried out by that technology. Application of biotechnology is one such possibility.

When reproducing a stream storing audio data on which attribute information, such as presence or absence of a bandwidth extension function, the sampling frequency, the number of channels, and the like, is switched in the middle of reproduction, the data reproduction device according to the present invention achieves seamless reproduction of such a stream even at the switching positions of the attribute information, and therefore is of great value particularly for devices such as a mobile terminal, a car navigation system, and the like which receive digital broadcasts.

The invention claimed is:

1. A data reproduction device for reproducing a coded stream including a plurality of pieces of frame data obtained by coding audio data and including bandwidth extension information used for extending a reproduction frequency band of a first part of the plurality of pieces of frame data, said data reproduction device comprising:

an obtainment unit obtaining a basic sampling frequency of the plurality of pieces of frame data of the coded stream;

a determination unit determining an output sampling frequency at which the plurality of pieces of frame data are to be reproduced, such that (i) the output sampling frequency is determined to equal the basic sampling frequency, when the basic sampling frequency is greater than a predetermined value, and (ii) the output sampling frequency is determined to not equal the basic sampling frequency, such that the output sampling frequency equals a frequency obtained by extending the reproduction frequency band of the first part of the plurality of pieces of frame data using the bandwidth extension information, when the basic sampling frequency is less than or equal to the predetermined value; and a decoding unit including a processor decoding the plurality of pieces of frame data, such that (i) when the determination unit determines the output sampling frequency to equal the basic sampling frequency, the decoding unit decodes the plurality of pieces of frame data at the basic sampling frequency and (ii) when the determination unit determines the output sampling frequency to not equal the basic sampling frequency, (a) the decoding unit decodes the first part of the plurality of pieces of frame data at the basic sampling frequency determined by the determination unit and extends the reproduction frequency band of the decoded first part of the plurality of pieces of frame data using the bandwidth extension information and (b) the decoding unit decodes a remaining part of the plurality of pieces of frame data at the basic sampling frequency and then upsamples the decoded remaining part of the plurality of pieces of frame data to the output sampling frequency determined by the determination unit, such that the extended first part of the plurality of pieces of frame data and the upsampled remaining part of the plurality of pieces of frame data have matching sampling frequencies.

2. The data reproduction device according to claim 1, wherein the determination unit determines the output sampling frequency to equal the frequency obtained by extending the reproduction frequency band of the first part of the plurality of pieces of frame data using the bandwidth extension information, only when the basic sampling frequency is a specific value.

3. The data reproduction device according to claim 1, wherein the obtainment unit obtains, from the coded stream, identification information indicating a possibility that the coded stream includes both the first part of the plurality of pieces of frame data having the bandwidth extension information and another part of the plurality of pieces of frame data not having the bandwidth extension information, and wherein the determination unit determines the output sampling frequency based on the basic sampling frequency and the identification information.

4. A data reproduction method of reproducing, via a data reproduction device, a coded stream including a plurality of pieces of frame data obtained by coding audio data and including bandwidth extension information used for extending a reproduction frequency band of a first part of the plurality of pieces of frame data, said data reproduction method comprising:

obtaining, via an obtainment unit of the data reproduction device, a basic sampling frequency of the plurality of pieces of frame data of the coded stream;

determining an output sampling frequency at which the plurality of pieces of frame data are to be reproduced, such that (i) the output sampling frequency is determined to equal the basic sampling frequency, when the basic sampling frequency is greater than a predetermined value, and (ii) the output sampling frequency is determined to not equal the basic sampling frequency, such that the output sampling frequency equals a frequency obtained by extending the reproduction frequency band of the first part of the plurality of pieces of frame data using the bandwidth extension information, when the basic sampling frequency is less than or equal to the predetermined value; and decoding the plurality of pieces of frame data, such that (i) when said determining determines the output sampling frequency to equal the basic sampling frequency, said decoding decodes the plurality of pieces of frame data at the basic sampling frequency and (ii) when said determining determines the output sampling frequency to not equal the basic sampling frequency, (a) said decoding decodes the first part of the plurality of pieces of frame data at the basic sampling frequency determined by said determining and extends the reproduction frequency band of the decoded first part of the plurality of pieces of frame data using the bandwidth extension information and (b) said decoding decodes a remaining part of the plurality of pieces of frame data at the basic sampling frequency and then upsamples the decoded remaining part of the plurality of pieces of frame data to the output sampling frequency determined by said determining, such that the extended first part of the plurality of pieces of frame data and the upsampled remaining part of the plurality of pieces of frame data have matching sampling frequencies.

5. A non-transitory computer-readable recording medium having a program recorded thereon, the program for reproducing a coded stream including a plurality of pieces of frame data obtained by coding audio data and including bandwidth extension information used for extending a reproduction frequency band of a part of the plurality of pieces of frame data, the program causing a computer to execute a method comprising:

obtaining a basic sampling frequency of the plurality of pieces of frame data of the coded stream;

determining an output sampling frequency at which the plurality of pieces of frame data are to be reproduced, such that (i) the output sampling frequency is determined to equal the basic sampling frequency, when the basic sampling frequency is greater than a predetermined value, and (ii) the output sampling frequency is determined to not equal the basic sampling frequency, such that the output sampling frequency equals a frequency obtained by extending the reproduction frequency band of the first part of the plurality of pieces of frame data using the bandwidth extension information, when the basic sampling frequency is less than or equal to the predetermined value; and decoding the plurality of pieces of frame data, such that (i) when said determining determines the output sampling frequency to equal the basic sampling frequency, said decoding decodes the plurality of pieces of frame data at the basic sampling frequency and (ii) when said determining determines the output sampling frequency to not equal the basic sampling frequency, (a) said decoding decodes the first part of the plurality of pieces of frame data at the basic sampling frequency determined by said determining and extends the reproduction frequency band of the decoded first part of the plurality of pieces of frame data using the bandwidth extension information and (b) said decoding decodes a remaining part of the plurality of pieces of frame data at the basic sampling frequency and then upsamples the decoded remaining part of the plurality of pieces of frame data to the output sampling frequency determined by said determining, such that the extended first part of the plurality of pieces of frame data and the upsampled remaining part of the plurality of pieces of frame data have matching sampling frequencies.

6. An integrated circuit for reproducing a coded stream including a plurality of pieces of frame data obtained by coding audio data and including bandwidth extension information used for extending a reproduction frequency band of a part of the plurality of pieces of frame data, said integrated circuit comprising:

an obtainment unit obtaining a basic sampling frequency of the plurality of pieces of frame data of the coded stream;

a determination unit determining an output sampling frequency at which the plurality of pieces of frame data are to be reproduced, such that (i) the output sampling frequency is determined to equal the obtained basic sampling frequency, when the basic sampling frequency is greater than a predetermined value, and (ii) the output sampling frequency is determined to not equal the basic sampling frequency, such that the output sampling frequency equals a frequency obtained by extending the reproduction frequency band of the first part of the plurality of pieces of frame data using the bandwidth extension information, when the basic sampling frequency is less than or equal to the predetermined value; and a decoding unit decoding the plurality of pieces of frame data, such that (i) when the determination unit determines the output sampling frequency to equal the basic sampling frequency, the decoding unit decodes the plurality of pieces of frame data at the basic sampling frequency and (ii) when the determination unit determines the output sampling frequency to not equal the basic sampling frequency, (a) the decoding unit decodes the first part of the plurality of pieces of frame data at the basic sampling frequency determined by the determination unit and extends the reproduction frequency band of the decoded first part of the plurality of pieces of frame data using the bandwidth extension information and (b) the decoding unit decodes a remaining part of the plurality of pieces of frame data at the basic sampling frequency and then upsamples the decoded remaining part of the plurality of pieces of frame data to the output sampling frequency determined by the determination unit, such that the extended first part of the plurality of pieces of frame data and the upsampled remaining part of the plurality of pieces of frame data have matching sampling frequencies.

* * * * *